US005172969A

United States Patent [19]

Reuter et al.

[11] Patent Number: 5,172,969

[45] Date of Patent: Dec. 22, 1992

[54] OVERHEAD CABINET WITH ROTATING DOOR

[75] Inventors: Robert Reuter, Stony Brook, N.Y.; Wallace C. Bullwinkle, Norristown, Pa.; Larry L. Hoff, East Greenville, Pa.; Robert E. Anderson, Palm, Pa.; Arkady Golynsky, Allentown, Pa.; Al Schmidt, Reinholds, Pa.

[73] Assignee: Westinghouse Electric Corp., Pittsburgh, Pa.

[21] Appl. No.: 756,742

[22] Filed: Sep. 9, 1991

[51] Int. Cl.[5] ..... A47B 96/00

[52] U.S. Cl. ..... 312/328; 16/358; 312/319.2

[58] Field of Search ..... 16/257, 258, 259, 260; 312/327, 328, 319

[56] References Cited

U.S. PATENT DOCUMENTS

| | | | |
|---|---|---|---|
| D. 278,010 | 3/1985 | Ostrander . | |
| 1,068,391 | 7/1913 | Jensen . | |
| 1,115,345 | 10/1914 | Steuernagel . | |
| 1,115,465 | 10/1914 | Goddin . | |
| 2,376,966 | 3/1945 | Ingerman . | |
| 2,551,305 | 5/1951 | Tompkins | 312/308 X |
| 2,590,028 | 3/1952 | Miller . | |
| 2,648,516 | 8/1953 | Manetti et al. . | |
| 2,689,101 | 9/1954 | Dygert . | |
| 2,793,387 | 5/1957 | Odell | 16/358 |
| 2,853,352 | 9/1958 | Gittins . | |
| 3,001,225 | 9/1961 | Squire | 16/358 X |
| 3,038,196 | 6/1962 | Nyquist | 16/358 |
| 3,539,239 | 11/1970 | Mallonn . | |
| 4,076,203 | 2/1978 | McDonnell . | |
| 4,953,259 | 9/1990 | Frye et al. | 16/358 X |

*Primary Examiner*—Peter R. Brown
*Attorney, Agent, or Firm*—B. R. Studebaker

[57] ABSTRACT

A cabinet is provided with a curved, upwardly-swinging door and interior shelves. The curved shelf door is mounted on a pair of opposed arms which rotate on a horizontal axis. Each arm is provided with two opposed, circularly arcuate slots and a central ellipsoidal slot, each slot engaging a fixed stud at the side of the cabinet. The ellipsoidal slot and its corresponding stud provide a center pivot for each of the arms. The arms are mounted inside the cabinet on opposed interior side walls. Lighting can be provided in a formed recess in the bottom of the cabinet. The cabinet can also be provided with plural internal shelves supported on planar brackets. The cabinet further can be provided with a pair of side-by-side doors and a center wall. Arms are mounted on each side of the center wall and adjacent the interior side walls of the cabinet, for separately mounting the doors.

30 Claims, 11 Drawing Sheets

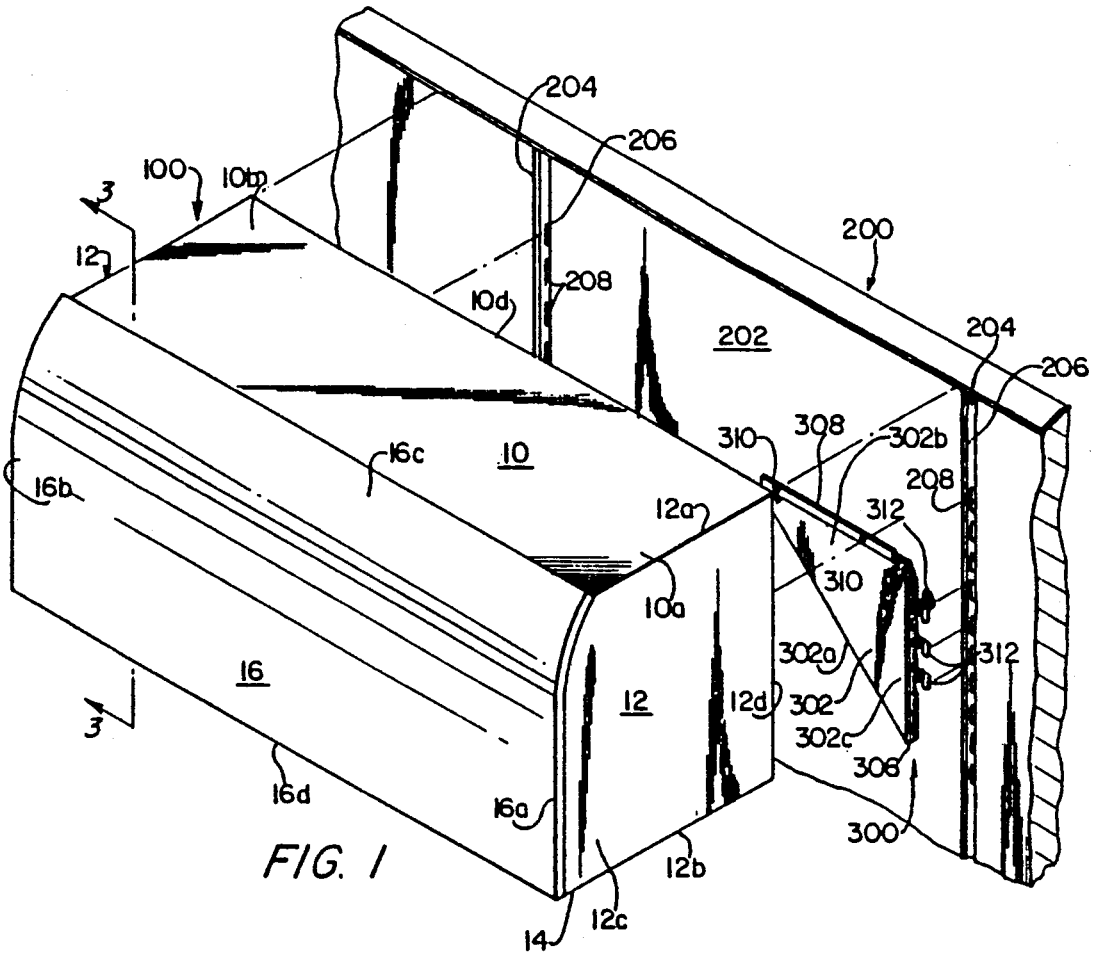
FIG. 1
FIG. 2
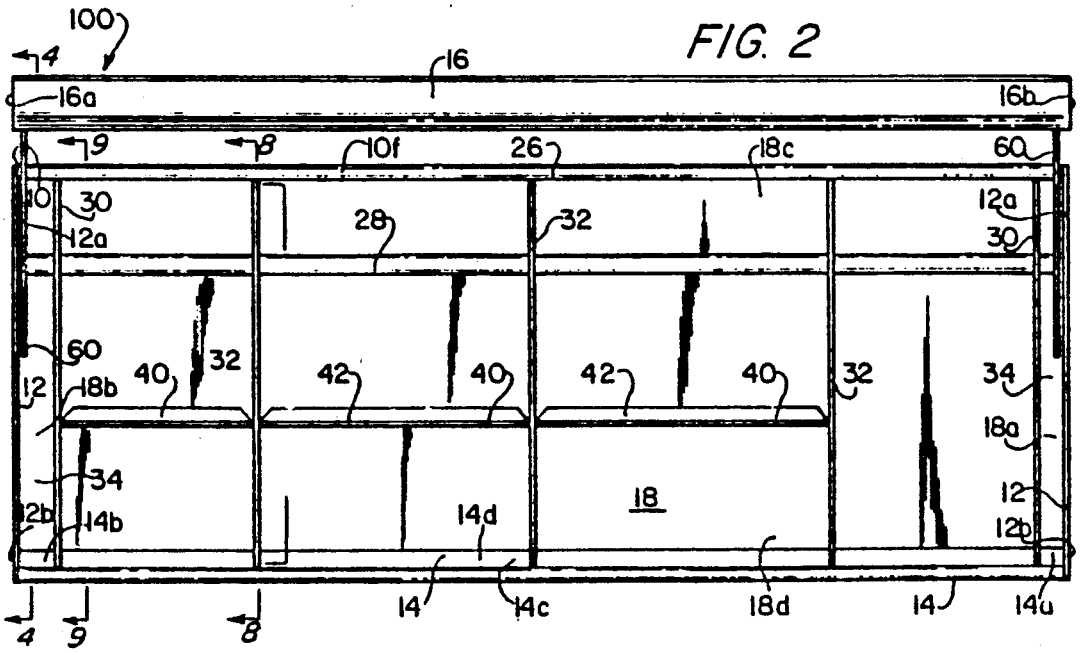

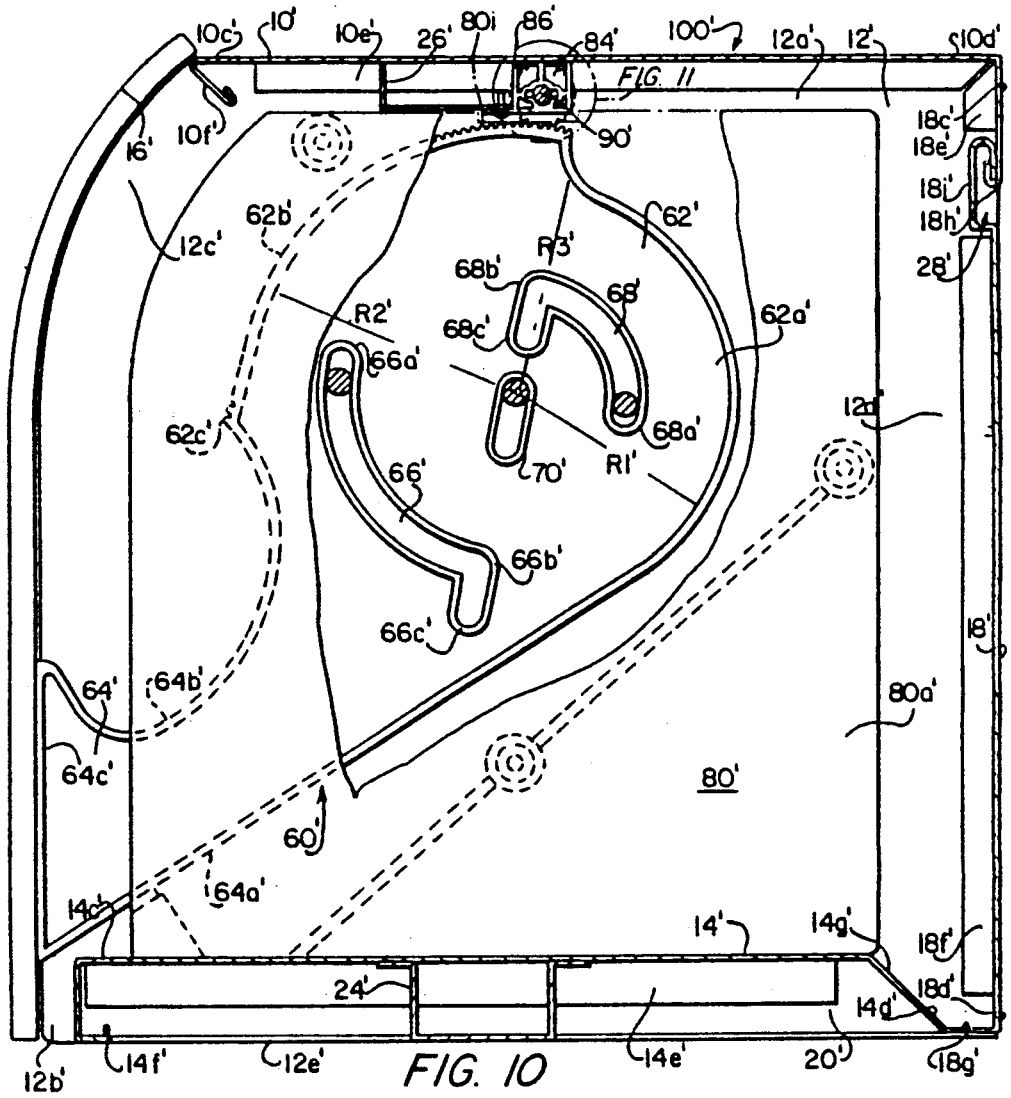
FIG. 10
FIG. 11
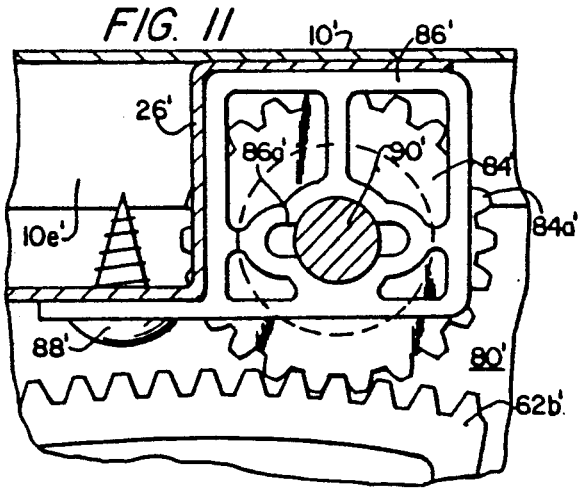
FIG. 12
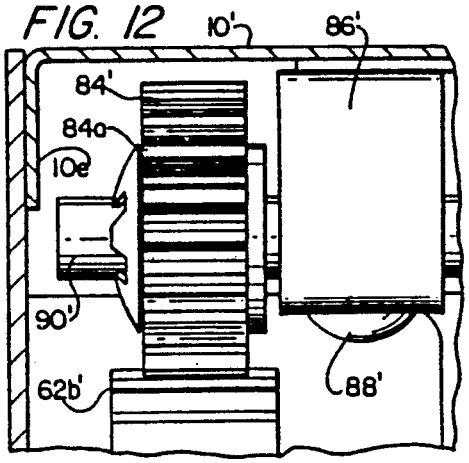

OVERHEAD CABINET WITH ROTATING DOOR

BACKGROUND OF THE INVENTION

1. Field of the Invention

The present invention relates to cabinets having upwardly-movable or rotatable doors. More specifically the invention relates to cabinets with upwardly-movable curved doors in which the door in the open position is stored outside the cabinet, and in which the cabinet is provided with interior shelves.

2. Related Art

Conveniently located and easily accessible storage space is highly desirable and often required in the office environment. Since office space is often at a premium, designers of office furniture desire to provide large amounts of easily accessed storage space in furniture structures located adjacent to work areas or other furniture. Storage furniture which is aesthetically appealing as well as functional is also highly desired.

In modular office furniture systems, one way of providing storage space adjacent a work area is to mount a cabinet or shelf vertically above, and spaced apart from, a desk or work surface. Typically, such cabinets are secured to a vertical modular wall panel adjacent the work surface. This type of mounting arrangement enables the furniture designer to efficiently use storage space which ordinarily is unused, above the office worker's head.

However, vertical mounting of storage cabinets creates certain furniture design problems. For example, when movable doors are used to conceal the contents of overhead storage cabinets, convenient means to raise and lower the door must be provided. Since the office worker must reach up and push the door upward to open the door, the door must be either relatively light in weight or provided with a balancing system to facilitate upward movement.

The direction of motion chosen for the door is also critical. The door can be constructed to swing into the cabinet structure or outside the structure. In the prior art, "pocket" doors are well known, and combine a hinge and drawer slide to enable the door to be swung up and then pushed on the slide into the cabinet. However, such pocket doors reduce the usable interior volume of the cabinet because the door occupies interior space when retracted. Consequently, door structures in which the retracted door swings outside and above the cabinet structure are desirable.

The prior art includes certain patents generally disclosing cabinets having swing-up doors using a mechanical linkage guided on tracks. For example, U.S. Pat. No. 1,115,345 (Steuernagel) discloses a cabinet structure having a swing-up door provided with two pairs of projecting pins which are guided in two pairs of curved tracks. The curved tracks are routed into the upper wood frame members of the cabinet, so that the door retracts into the cabinet.

Similarly, U.S. Pat. No. 2,590,028 (Miller) shows a swing-up door having two guide bolts or studs which traverse curved tracks. The tracks are cut in plates which are secured to the interior of the cabinet.

U.S. Pat. No. 2,648,516 (Manetti, et al) related to a dispenser bracket provided with three arcuate tracks which permit placing a tissue dispenser or other device in a plurality of positions.

U.S. Pat. No. 2,853,352 (Gittins) is directed to an upright cabinet with plural drawers each of which is suspended on a fixed pivot. Twin arcuate channels are provided to guide bolts or studs projecting outwardly into the channels.

U.S. Pat. No. 3,539,239 (Mallonn) discloses a cabinet having a retractable door provided with two can pins guided through spaced-apart interior flanges formed on side walls.

U.S. Pat. No. 1,115,465 (Goddin) depicts a shelf support provided with three parallel rows of slots which are aligned to receive tabs of another shelf support made according to the invention. However, the slots do not receive shelves.

Thus, the prior art is deficient in not providing a storage cabinet for modular or other furniture systems in which a rotatable retractable door is stored outside the cabinet when in the open position, and which also provides interior shelves. It is the solution of this and other problems to which the present invention is directed.

SUMMARY OF THE INVENTION

In accordance with the present invention, a cabinet is provided with a curved, upwardly-swinging door and interior shelves. The curved shelf door is mounted on a pair of opposed arms which rotate on a horizontal axis. Each arm is provided with two opposed arcuate slots and an elongated slot, each slot engaging a fixed stud mounted on the inside side wall of the cabinet. The elongated slot and its corresponding stud provide a center pivot for each of the arms. The arms are mounted inside the cabinet adjacent oppose interior side walls.

In one aspect of the invention, lighting is provided in a formed recess in the bottom of the cabinet. In another aspect of the invention, the cabinet is provided with plural internal shelves supported on planar brackets.

In yet another aspect of the invention, the cabinet is provided with a pair of side-by-side doors and a center wall. Arms are mounted adjacent each side of the center wall and adjacent the interior side walls of the cabinet, for separately mounting the doors.

The foregoing structure of the present invention is provided to carry out the following enumerated objects of the invention, and other objects which will become apparent from the detailed description of the preferred embodiments below.

One object of the invention is to provide a rotatably mounted door for a cabinet or other article of furniture in which the door is stored outside the cabinet when in the open position.

Another object of the present invention is to provide an overhead storage cabinet for modular or other furniture systems provided with an easily operated and conveniently located access door.

Another object of the present invention is to provide an overhead storage cabinet with an upwardly movable door using a minimum of hardware which occupies a minimum of cabinet interior space.

A further object of the present invention is to provide an overhead storage cabinet having plural internal shelf brackets which also function as interior space dividers.

Yet another object of the present invention is to provide an overhead storage cabinet having plural generally planar internal shelf brackets which are aesthetically appealing without sacrificing functionality.

Still another object of the present invention is to provide an overhead storage cabinet having a lighting system mounted therein.

A further object of the present invention is to provide an overhead storage cabinet which can be mounted to modular office furniture wall panels.

BRIEF DESCRIPTION OF DRAWINGS

The invention is better understood by reading the following Detailed Description of the Preferred Embodiments with reference to the accompanying drawing figures, in which like reference numerals refer to like elements throughout, and in which:

FIG. 1 is a partially exploded perspective view of a cabinet according to a first embodiment of the present invention shown with a mounting bracket for mounting the cabinet to a supporting wall structure.

FIG. 2 is a front elevational view of the cabinet of FIG. 1 shown with the door in the raised, open position.

FIG. 10 is a cross-sectional view with parts broken away of a cabinet according to a second embodiment of the invention.

FIG. 11 is an enlarged side elevational view showing the structure indicated by the dashed circle in FIG. 10.

FIG. 12 is a rear elevational view of the structure of FIG. 11.

DETAILED DESCRIPTION OF THE PREFERRED EMBODIMENTS

Figure 3:
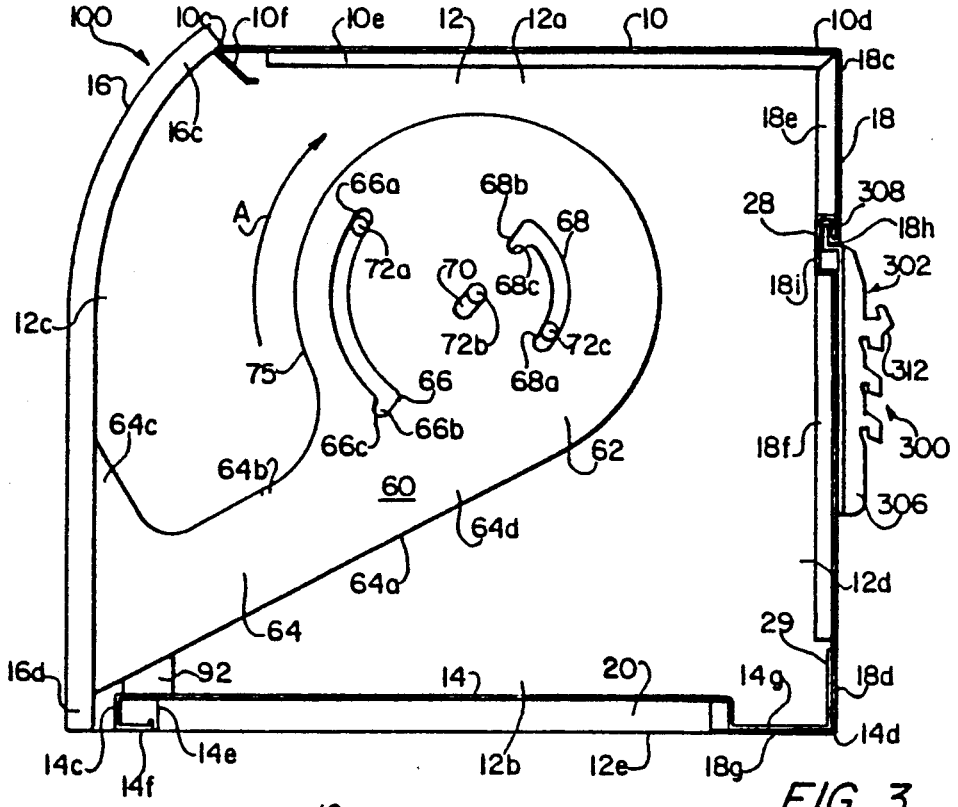
FIG. 3 is a cross-sectional view taken along line 3—3 of FIG. 1.

In the following detailed description of the preferred embodiments, specific terminology is used for the sake of clarity. However, the present invention is not intended to be limited to the specific terms used, and it is to be understood that each element includes all technical equivalents which operate in a substantially similar manner to accomplish a substantially similar purpose.

Referring now to FIGS. 1 through 9, there is shown a first embodiment of the present invention. A cabinet 100 according to the present invention is adapted for mounting on a modular furniture panel assembly 200 by a pair of mounting brackets 300, as will be described in greater detail hereinafter.

As shown in FIGS. 1 through 9, cabinet 100 is a generally rectangular box having a generally rectangular top wall 10 having opposed side edges **10*a* and 10*b* (FIG. 1), opposed front and back edges 10*c* and 10*d* (FIGS. 1, 3, 4, 8, and 9), opposed flanges 10*e* extending vertically downwardly from side edges 10*a* and 10*b* (FIGS. 3 and 4), and a fascia strip 10*f* (FIGS. 2–5, 8, and 9) extending downwardly from front edge 10*c*; two symmetrically identical, opposed end walls 12 (FIGS. 1–5, 8, and 9) each having opposed top and bottom edges 12*a* and 12*b* (FIGS. 1–4), opposed front and back edges 12*c* and 12*d* (FIGS. 1, 3, and 4), and a flange 12*e* (FIGS. 3 and 4) extending horizontally inwardly from bottom edges 12*b*; a generally rectangular bottom wall 14 (FIGS. 2–5, 8, and 9) having opposed side edges 14*a* and 14*b* (FIG. 2) and opposed front and back edges 14*c* and 14*d* (FIGS. 2, 5, 8, and 9); and a rectangular rear wall 18 (FIGS. 2–5, 8, and 9) having opposed side edges 18*a* and 18*b* (FIG. 2), and opposed top and bottom edges 18*c* and 18*d* (FIGS. 2–4, 8, and 9**).

An upwardly-movable cabinet door 16 (FIGS. 1–5) having opposed side edges **16*a* and 16*b* (FIGS. 1 and 2) and opposed top and bottom edges 16*c* and 16*d* (FIGS. 1, 3, and selectively provides access to the interior of cabinet 100. Door 16 is substantially planar adjacent bottom edge 16*d* and is arcuate adjacent top edge 16*c***.

Figure 8:
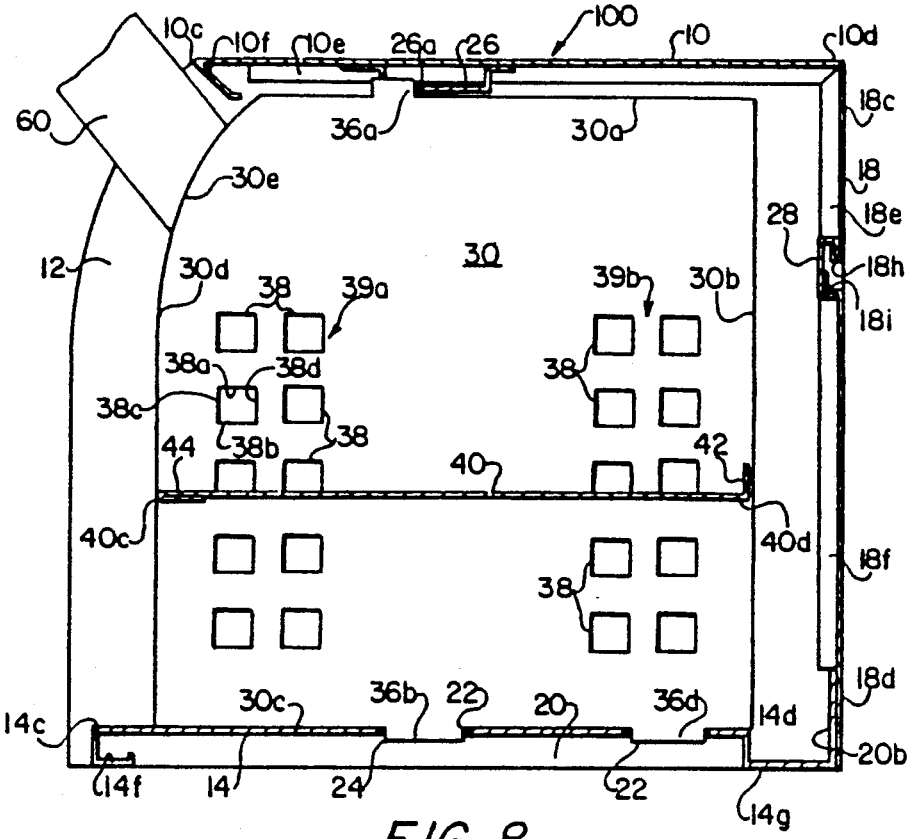
FIG. 8 is a cross-sectional view taken on line 8—8 of FIG. 2.

The upper part of rear wall 18 adjacent top edge **18*c* is formed unitarily with top wall 12, and is separate from the lower part of rear wall 18. Referring now to FIGS. 3 and 8, spaced, upper and lower flanges 18*e* and 18*f* extend vertically inwardly from side edges 18*a* and 18*b* of rear wall 18, and a flange 18*g* extends horizontally inwardly from bottom edge 18*d*. The upper part of rear wall 18 has a narrow J-shaped flange 18*h* formed therein, for a purpose to be described hereinafter. The lower part of rear wall 18 has an L-shaped flange 18*i*** extending inwardly at the top thereof, also for a purpose to be described hereinafter.

Referring now to FIGS. 3, 4, 8, and 9, side edges **14*a* and 14*b* of bottom wall 14 include inwardly facing C-shaped flanges 14*e*, while front edge 14*c* of bottom wall 14 includes a rearwardly-facing C-shaped channel 14*f*, and back edge 14***d* includes a forwardly-facing J-shaped flange 14*g*. The forward, shorter vertical leg of the "J" is connected to the upper horizontal legs of each "C" to define a cavity 20 under bottom wall 14, in which accessories can be mounted, as will be described in detail hereinafter with respect to the second embodiment of the invention. As shown in FIG. 8, bottom wall 14 also is provided with plural pairs of elongate slots 22 therethrough, also for a purpose to be described hereinafter.

As best shown in FIGS. 3 and 8, the sides of flanges 10*e*, 14*e*, 18*e*, and 18*f* engage the inner surface of end walls 12, and are secured thereto by conventional means such as spot welding. Also, the bottom surface of flange 14*e* engages the upper surface of flange 12*e*, the rearward surface of flange 14*g* engages the inner surface of rear wall 18, and the upper surface of flange 18*g* engages the lower surface of flange 14*g*, these likewise being secured to each other by conventional means.

Figure 5:
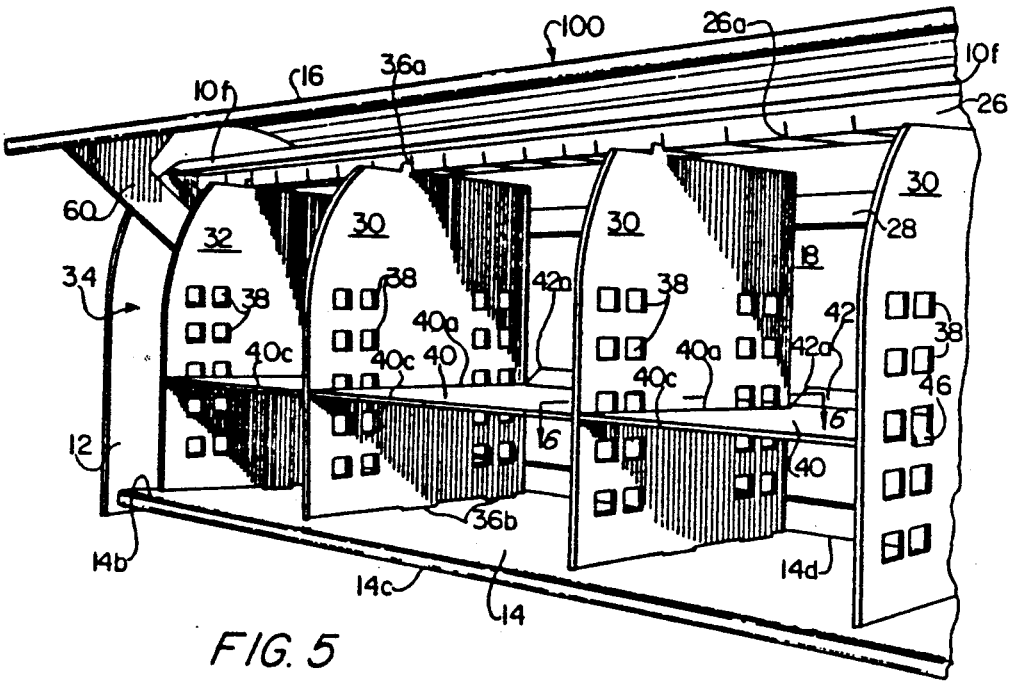
FIG. 5 is a partial perspective view showing the cabinet with the door in the raised, open position.
Figure 6:
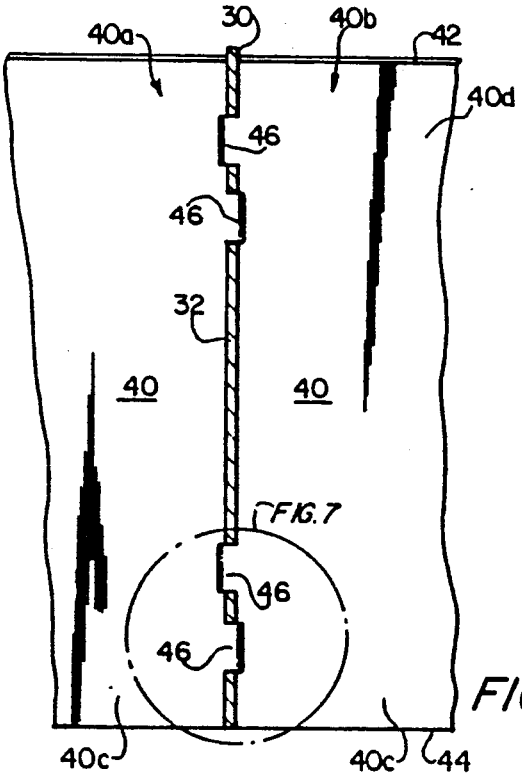
FIG. 6 is a cross-sectional view taken along line 6—6 of FIG. 5.
Figure 9:
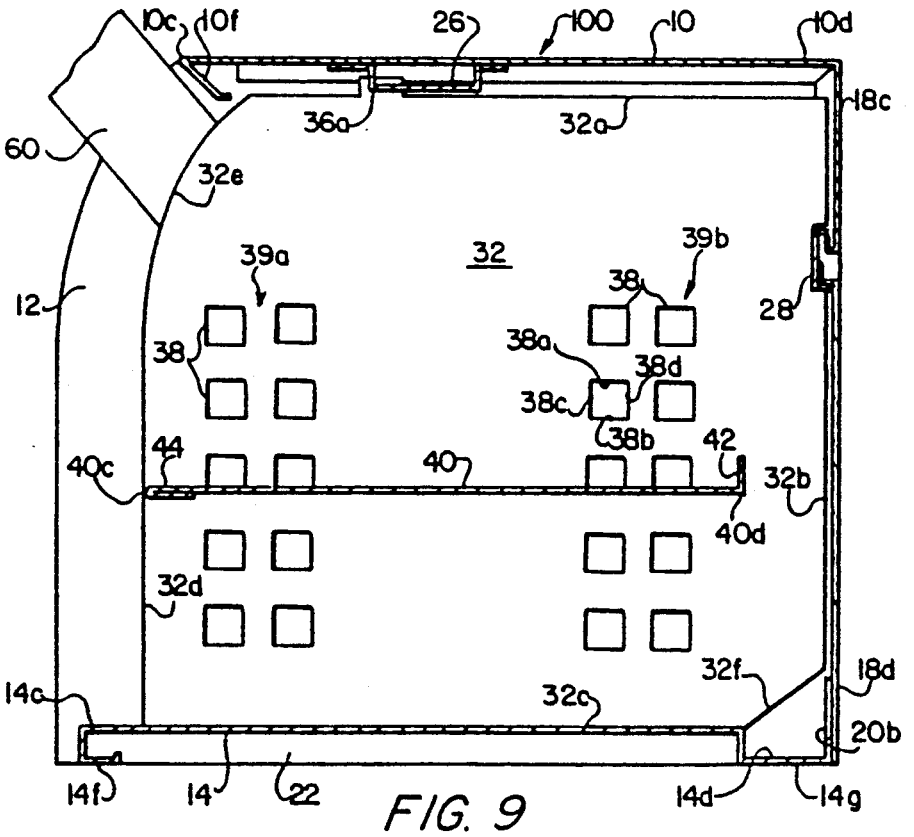
FIG. 9 is a cross-sectional view taken along line 9—9 of FIG. 2

As indicated in FIGS. 5, 6 and 9, a guide channel 26 is secured to the lower surface of top wall 10 intermediate front and back edges 10*a* and 10*b*. Channel 26 is provided with a plurality of parallel, rearwardly-extending slots 26*a*, for a purpose to be described hereinafter. As best seen in FIGS. 5, 8, and 9, fascia strip 10*f* is formed integrally with front edge 10*c* of top wall 10 to conceal guide channel 26 so that channel 26 cannot be seen when the cabinet 100 is viewed from the front.

As shown in FIGS. 2, 3, 5, 8, and 9, rear wall 18 is provided with an inwardly formed horizontally elongated channel 28, for a purpose to be described hereinafter.

Referring now to FIG. 2, cabinet 100 is shown with door 16 in the raised position. Cabinet 100 is provided with two outer vertical shelf brackets 32 spaced apart from side walls 12, plural intermediate vertical shelf brackets 30 positioned between outer shelf brackets 32, and plural horizontal shelves 40 supported between shelf brackets 30 and 32 in a manner to be described hereinafter.

As best seen in FIGS. 5, 8, and 9, each of intermediate shelf brackets 30 is generally rectangular in shape, having a top edge 30*a*, a rear edge 30*b*, a bottom edge 30*c*, and a front edge 30*d*. Although each shelf bracket 30 is generally rectangular, front edge 30*d* is connected to top edge 30*a* by an arcuate corner portion 30*e* generally parallel to the arcuate profile of the door 16 of cabinet 100. Rear edge 30*b* is spaced apart from wall 18.

Each of outer shelf brackets 32 also is generally rectangular, having a top edge 32*a*, a rear edge 32*b*, a bottom edge 32*c*, and a front edge 32*d*. Like shelf brackets 30, although each shelf bracket 32 is generally rectangular, front edge 32*d* is connected to top edge 32*a* by an arcuate corner portion 32*e* generally parallel to the arcuate profile of the door 16 of cabinet 100. Also, rear edge 32*b* is joined to bottom edge 32*c* by a relatively short angular corner portion 32*f*, which is disposed at an angle of approximately 45° with respect to horizontal (i.e., at an angle of approximately 135° to rear edge 32*b* and bottom edge 32*c*). Rear edge 32*b* contacts rear wall 18 when bracket 32 is installed in cabinet 100.

Brackets 30 and 32 each further include a top tab 36*a* projecting upwardly from top edges 30*a* and 32*a* and plural, spaced-apart bottom tabs 36*b* projecting downwardly from bottom edges 30*c* and 32*c*. When a shelf bracket 30 or 32 is mounted in cabinet 100, tab 36*a* is inserted into and engages a transverse slot 26*a* in elongated shelf bracket guide 26, as shown in FIGS. 5, 8, and 9. Similarly, bottom tabs 36*b* are inserted into and engage slots 22 in bottom wall 14 such that tabs 36*b* project into cavity 20, as shown in FIG. 8. Tabs 36*a* and 36*b* and slots 26*a* and 22 are constructed to provide a tight friction fit between the respective parts so that brackets 30 and 32 are firmly and rigidly locked between bottom wall 14 and guide channel 26.

Brackets 30 and 32 are provided with plural punched or cut-out shelf-receiving openings 38, preferably formed in a rectangular shape, although many other shapes are contemplated such as circles, squares, and triangles. As shown in FIGS. 5, 8, and 9, openings 38 have a downwardly-facing upper surface 38*a*, an upwardly-facing lower surface 38*b*, and opposed inwardly-facing side surfaces 38*c* and 38*d*. The openings 38 are arranged in two pairs 39*a* and 39*b* of vertically parallel rows. Forward pair of rows 39*a* provides support for the front of a shelf 40 while rearward pair of rows 39*b* provides support for the rear of shelf 40, as will be described in detail hereinafter. Using pairs 39*a* and 39*b* of the rows of plural openings 38, shelves 40 can be mounted selectively in plural positions each spaced above bottom wall 14 by the same distance, as shown in FIG. 5, or by a different distance.

Shelves 40 are preferably constructed of relatively thin rigid sheet material such as sheet aluminum or steel. Referring now to FIGS. 2 and 5–9, shelves 40 are generally rectangular and have opposed side edges 40*a* and 40*b* and opposed front and back edges 40*c* and 40*d*. Each back edge 40*d* is provided with a generally perpendicular, upwardly extending lip 42 which adds structural rigidity to shelf 40. The side edges 42*a* of lip 42 are formed at an angle of approximately 45° to the horizontal, as shown in FIG. 5. Lip 42 also acts as a rear stop for shelves 40 and thereby prevents materials from being pushed rearward into space 34. Further structural stiffness is provided by folding under front edge 40*c* to provide a double-thickness.

Figure 7:
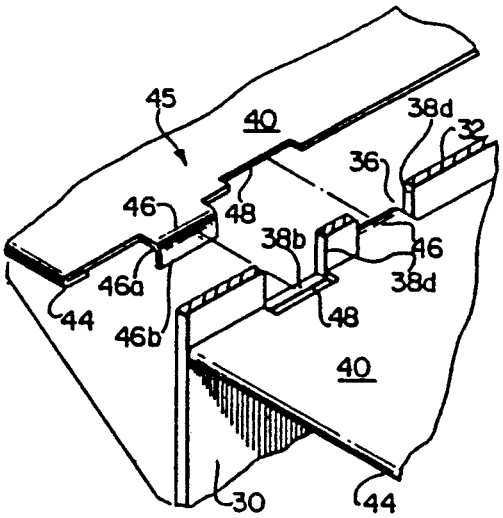
FIG. 7 is an enlarged, partially exploded, perspective view showing the structure indicated by the dashed circle in FIG. 6.

Shelves 40 engage openings 38 in brackets 30 and 32 using a combination of tabs 46 and notches 48 best illustrated in FIGS. 6 and 7. Each side 40*a* and 40*b* of shelves 40 is provided with forward and rearward downwardly-angled, L-shaped tabs 46 and forward and rearward notches 48. Tabs 46 are slightly narrower than openings 38 to engage openings 38 in brackets 30 and 32, and notches 48 are the same width as openings 38. The sides 40*a* and 40*b* of shelves 40 are oppositely symmetrical, as indicated in FIG. 8.

In the preferred arrangement of FIG. 6, each tab 46 is paired with a notch 48. The pairs of tabs 36 and notches 48 are in registration with the pairs 39*a* and 39*b* of openings 38. As best indicated in FIG. 7, when a shelf 40 is assembled to a shelf bracket 30 or 32, the bottom surface 46*a* of each tab 46 rests on the upwardly facing surface 38*b* of an opening 38. Notches 48 provide clearance space for the downwardly protruding legs 46*b* of tabs 46. In this fashion, corresponding tabs 46 and notches 48 of each shelf 40 interlock with openings 38 in two adjacent shelf brackets 30 or in adjacent shelf brackets 30 and 32. This arrangement permits support of shelves 40 using aesthetically appealing, nearly invisible holding means, namely the combination of tabs 46 and notches 48.

Figure 4:
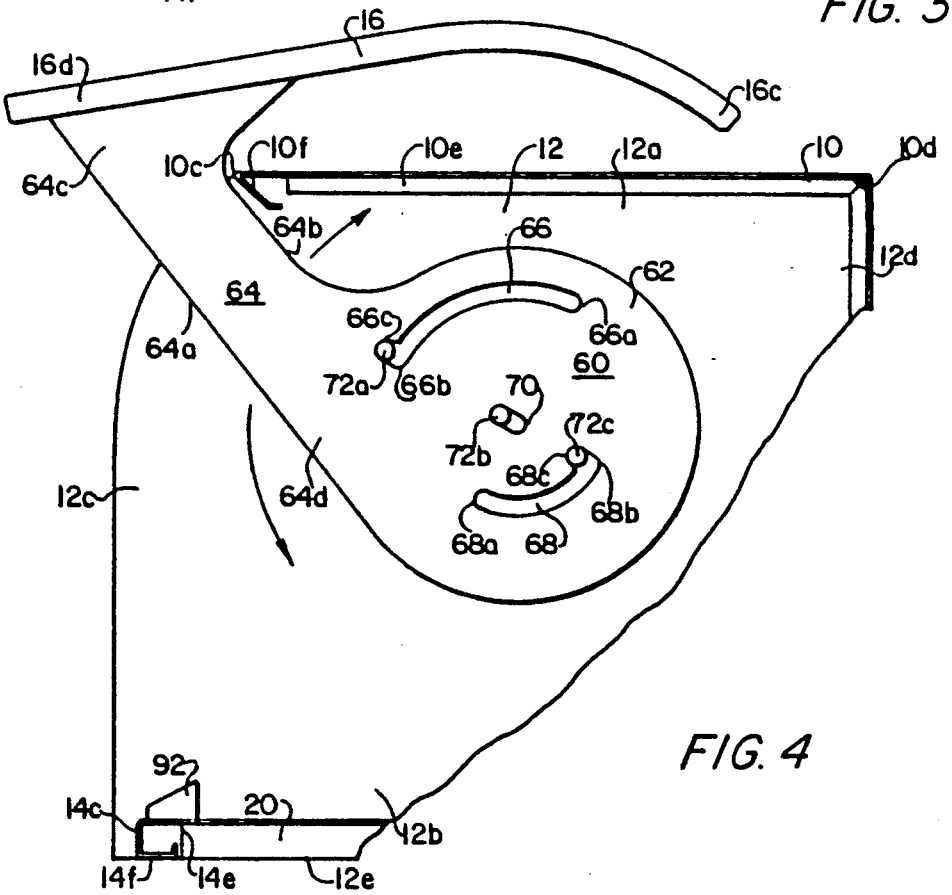
FIG. 4 is a cross-sectional view taken along line 4—4 of FIG. 2.

The following section describes the structure and operation of the upwardly movable door 16. As indicated in FIGS. 3 through 5, door 16 is operated using plural planar, rigid door pivot arms 60, which are pivotably mounted to the inner surfaces of end walls 12, as will be described in greater detail hereinafter. Arms 60 preferably are fabricated of material such as sheet aluminum or sheet steel, but can also be fabricated of injection molded plastic.

In the preferred embodiment, two arms 60 are provided, one at each of sides 16*a* and 16*b* of door 16. Arms 60 serve to movably connect sides 16*a* and 16*b* of door 16 to end walls 12 while restricting the movement of door 16 to an arcuate path. As specifically shown in FIGS. 2 and 5, arm 60 is fitted into the narrow space 34 between end wall 12 and bracket 30 of cabinet 100. This arrangement permits concealment of the door operating mechanism and ensures that a minimum of interior cabinet space is occupied by the door operating mechanism.

Arm 60 comprises a circular disk portion 62 integrally formed with a tangential arm portion 64 shown in FIG. 3. Arm portion 64 has a first side 64*a* formed as a tangent of disk portion 62, a second side 64*b* a portion of which is parallel to first side 64*a*, an outer end 64*c* which joins first and second sides 64*a* and 64*b*, and an inner end 64*d* which is coextensive with the circumference of disk portion 62. Side 64*a* forms an angle of approximately 59° with outer end 64*c*.

Side 64*b* is joined at either end by a smooth curve both to disk portion 62 and to side 64*c*, thereby defining an enlarged attachment portion which is secured to the inner surface of door 16 adjacent bottom edge 16*d*. Thus, when door 16 is closed as shown in FIG. 3, side 64*a* is arranged at an angle of approximately 31° relative to horizontal.

Disk portion 62 is provided with three cutout portions, namely a first arcuate slot 66, a second arcuate slot 68, and an ellipsoidal slot 70. One of the circles defining the ellipsoidal shape of slot 70 is preferably substantially concentric with disk portion 62, the center of the circle being offset very slightly from the center of disk portion 62, and slot 70 extending radially from the center of disk portion 62 towards slot 66. The major axis of ellipsoid is collinear with a radius of disk portion 62 and is arranged at an angle of approximately 54° with respect to horizontal and approximately 23° with respect to side 64*a*.

Slots 66 and 68 are circularly arcuate and concentric with disk portion 62, the radius of slot 66 being greater than the radius of slot 68, and slot 66 being longer than slot 68. By a radius of slot 66 or 68 is means a radius equal to the average of the inner and outer radii of each of slots 66 and 68. Slots 66 and 68 are arranged opposite each other and are non-parallel. Slot 66 is provided with a semicircular first end 66*a* and a second locking end 66*b* located adjacent inner end 64*d* of arm portion 64. This locking end 66*b* is formed by a semi-ellipsoidal notch 66*c* having a major axis collinear with the major axis of slot 70 and extending radially outwardly from slot 66. Slot 68 similarly includes a semicircular first end 68*a* and a second locking end 68*b* formed by a semi-ellipsoidal notch 68*c* having a major axis collinear with the major axis of slot 70, but extending radially inwardly from slot 68. First ends 66*a* and 68*a* are substantially diametrically opposite each other and collinear with the center of disk portion 62, the line which they define forming an angle of approximately 85° with the major axes of slot 70 and notches 66*c* and 68*c*.

Three inwardly-projecting cylindrical bolts or studs 72*a*, 72*b* and 72*c* are affixed to the interior surface of side wall 12 as shown in FIG. 3 to cooperate with slots 66, 70, and 68 respectively. Studs 72*a*, 72*b*, and 72*c* are collinear, and form and angle of approximately 31° with the horizontal. When the cabinet 100 is assembled, stud 72*a* is received in and guides slot 66. Stud 72*b* acts as a central pivot and is received by slot 70. Stud 72*c* is received in and guides slot 68.

When the cabinet door 16 is moved upwardly in the direction of arrow A using manual force, arm 60 rotates around stud 72*b*. As shown in FIG. 4 the ellipsoidal shape of slot 70 enables arm 60 to move downward and rearward a slight amount in the fully open position, thereby causing engagement both of stud 72*a* with notch 66*c* and stud 72*c* with notch 68*c*. Studs 72*a* and 72*c* thus become locked against notches 66*c* and 68*c* preventing door 16 from dropping downward. However, when the door 16 is pulled upward a slight amount, studs 72*a* and 72*c* will disengage notches 66*c* and 68*c* respectively, thereby re-engaging slots 66 and 68. The door 16 can then be rotated downward to the closed position of FIG. 3.

As shown in FIGS. 3 and 4, bumpers 92 are provided on the upper surface of bottom wall 14 adjacent end walls 12 for engaging sides 64*b* of arms 60 in the closed position.

Cabinet 100 finds particular use as one part of an integrated modular furniture system (not shown) which includes one or more modular vertical wall panels such as panel 200 shown in FIG. 1. Panel 200 includes a planar front wall 202 provided with two elongated, vertical spaced-apart recesses or channels 204 in each of which an elongated standard 206 is vertically mounted. The standards 206 are conventional in design and are provided with plural spaces or slots 208 that are positioned along the longitudinal axis of standards 206 for receiving mounting brackets 300.

Although only one of brackets 300 is shown, it should be understood that they ar mirror-images of each other. Brackets 300 are preferably constructed with a generally right-triangular bracket body 302 having a hypotenuse edge 302*a*, a horizontal side edge 302*b*, a vertical side edge 302*c*, a rearwardly-facing vertical ledge 306 extending perpendicularly along the length of vertical side edge 302*c*, and a forward-facing L-shaped horizontal flange 308 extending perpendicularly along the length of horizontal side edge 302*b*.

Plural holes 310 are provided in flange 308 to secure bracket 300 to rear wall 18 of cabinet 100 using a corresponding number of conventional fasteners such as bolts or screws (not shown). As shown in FIG. 3, when brackets 300 are assembled to cabinet 100, flange 308 is received by and secured in channel 28. This arrangement permits cabinet 100 to hang on brackets 302 when the brackets 302 are secured to a modular furniture panel as shown in FIG. 1.

Vertical ledge 306 of bracket 300 is provided with plural rearward-facing bracket teeth 312 which engage slots 208 of standard 206. As shown in FIGS. 1 and 3, there are two lower, downward facing teeth 312 and one upper, bi-directional tooth 312. When cabinet 100 is mounted on modular wall 200, teeth 312 lock into slots 208, enabling cabinet 100 to securely but removably hang from standards 206.

Figure 13:
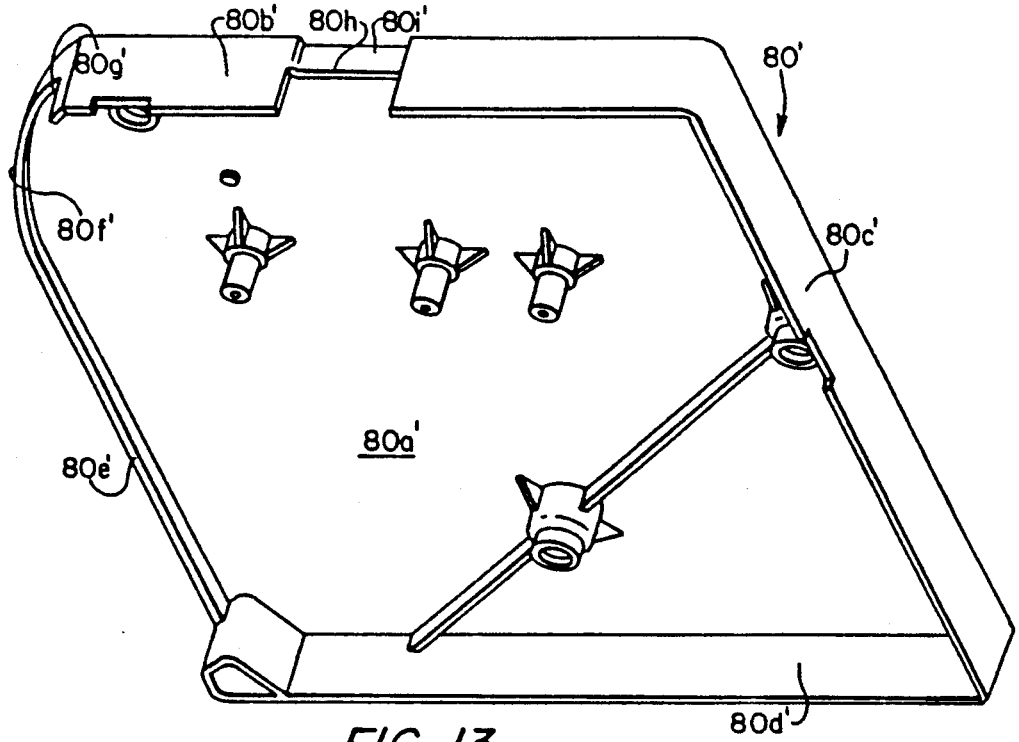
FIG. 13 is a perspective view of a cover plate for the mounting arm shown in FIG. 10.
Figure 14:
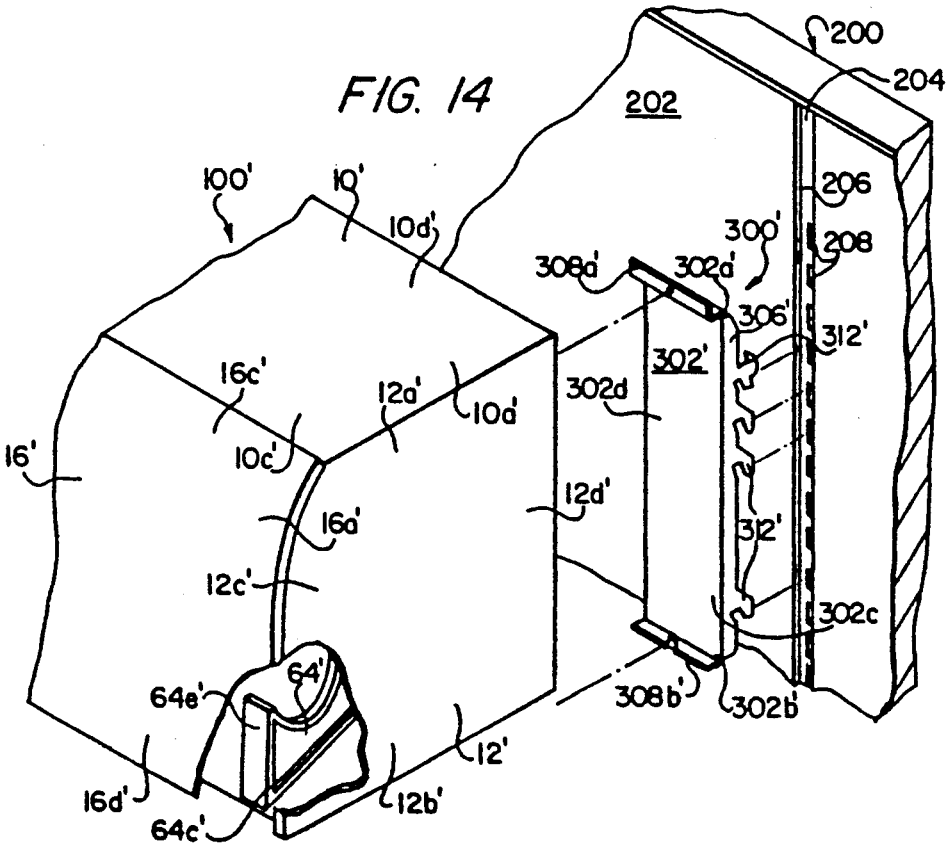
FIG. 14 is an exploded view with parts broken away of the cabinet of FIG. 10 shown with a mounting bracket for mounting the cabinet to a supporting wall structure.
Figure 15:
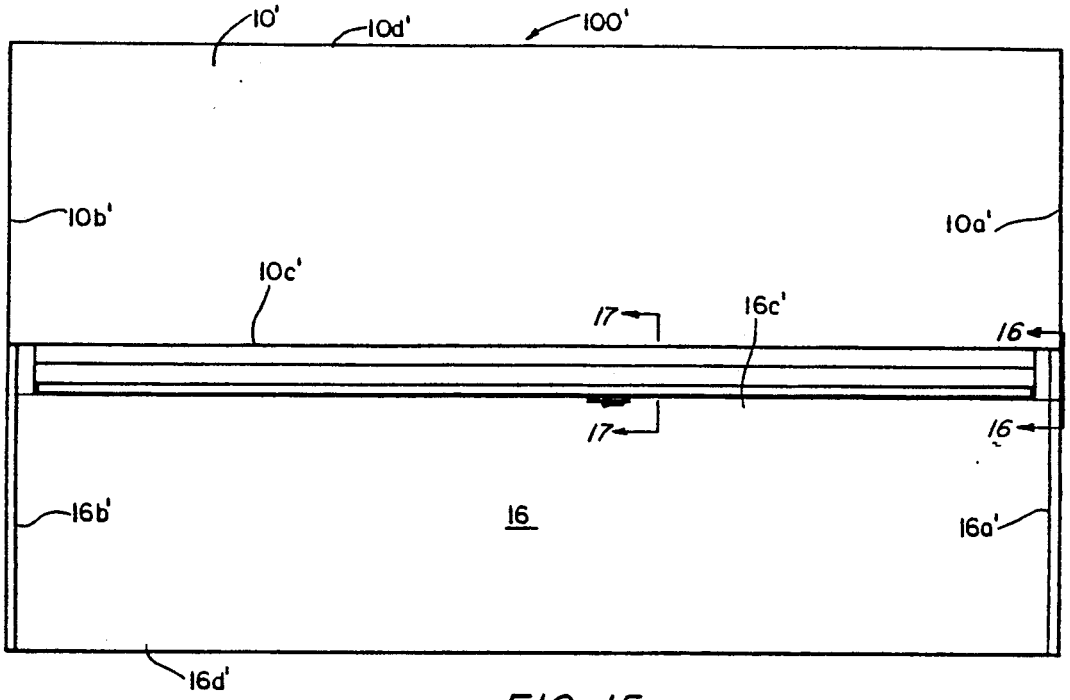
FIG. 15 is a top plan view of the cabinet of FIG. 10, having a lighting system mounted thereon.

Referring now to FIGS. 10–17 there is shown a cabinet 100' in accordance with a second embodiment of the invention. Cabinet 100' is generally similar to cabinet 100 shown in FIGS. 1–9, with differences as will be described hereinafter. As shown in FIGS. 10, 14, and 15, cabinet 100' includes a generally rectangular top wall 10' having opposed side edges 10*a'* and 10*b'* (FIG. 15), opposed front and back edges 10*c'* and 10*d'* (FIGS. 10, 14, and 15), opposed flanges 10*e'* (FIG. 10) extending vertically downwardly from side edges 10*a'* and 10*b'*, and a fascia strip 10*f'* (FIG. 10) extending downwardly from front edge 10*c'*; two symmetrically identical, opposed end walls 12' (FIGS. 10 and 14) each having opposed top and bottom edges 12*a'* and 12*b'* (FIGS. 10 and 14), opposed front and back edges 12*c'* and 12*d'* (FIGS. 10 and 14), and a flange 12*e'* (FIG. 10) extending horizontally inwardly from bottom edges 12*b'*; a generally rectangular bottom wall 14' (FIG. 10) having opposed side edges (not shown) and opposed front and back edges 14*c'* and 14*d'* (FIG. 10); and a rectangular rear wall 18' (FIG. 10) having opposed side edges (not shown), opposed top and bottom edges 18*c'* and 18*d'* (FIG. 10), spaced, upper and lower flanges 18*e'* and 18*f'* (FIG. 10) extending vertically inwardly from side edges 18*a'* and 18*b'*, and a flange 18*g'* (FIG. 10) extending horizontally inwardly from bottom edge 18*d'*. A curved, upwardly-movable cabinet door 16' (FIGS. 10, 13, and 15) similar to door 16 and having opposed side edges 16*a'* and 16*b'* (FIGS. 14 and 15) and opposed top and bottom edges 16*c'* and 16*d'* (FIGS. 14 and 15) selectively provides access to the interior of cabinet 100'.

The upper part of rear wall 18' adjacent top edge 18*c'* is formed unitarily with top wall 12', and is formed separately from the lower part of rear wall 18'. The upper part of rear wall 18' has a narrow, upwardly opening, J-shaped flange 18*h'* (FIG. 10) formed at the bottom thereof. The lower part of rear wall 18' has an inverted, wide, downwardly opening, J-shaped flange 18*i'* (FIG. 10) extending inwardly at the top thereof, the hook of flange 18*i'* engaging the hook of flange 18*h'* to define a substantially C-shaped channel 28'.

As shown in FIG. 10, the lower part of rear wall 18' is formed unitarily with bottom wall 14'. Side edges 14*a'* and 14*b'* of bottom wall 14' include downwardly facing vertical flanges 14*e'*, while front end 14*c'* of bottom wall 14' includes a rearwardly-facing C-shaped channel 14*f'*, and back end 14*d'* includes a downwardly and outwardly angled flange 14*g'*, the tops of flanges 14*e'*, 14*f'*, and 14*g'* being connected to define a cavity 20' under bottom wall 14'. A generally U-shaped support channel 24' is secured to the bottom surface of bottom wall 14' within cavity 20', for a purpose to be described hereinafter. Bottom wall 14' also is provided with plural pairs of elongate slots therethrough (not shown), similar to slots 22 in bottom wall 14 of cabinet 100.

The sides of flanges 10*e'*, 14*e'*, 18*e'*, and 18*f'* engage the inner surface of end walls 12', these surfaces being secured to each other by conventional means such as spot welding. Also, the back edge of flange 14*g'* is unitary with the forward edge of flange 18*g'*.

U-shaped support channel 24' is secured to the lower surface of bottom wall 14' in cavity 20' intermediate front and back edges 14*c'* and 14*d'*, and extending lengthwise across cabinet 100', for a purpose to be described hereinafter.

As indicated in FIGS. 10 and 11, a guide channel 26' is secured to the lower surface of top wall 10', similar to guide channel 26 in cabinet 100. Channel 26' is provided with a plurality of parallel, rearwardly-extending slots (not shown) similar to slots 26*a* in channel 26. A fascia strip 10*f'* similar to fascia strip 10*f* is formed integrally with front edge 10*c'* of top wall 10', as best seen in FIG. 10, to conceal guide channel 26'.

Cabinet 100' can be provided with vertical shelf brackets 30 and horizontal shelves 40 in a manner similar to cabinet 100, which are held in place by the slots in bottom wall 14' and channel 26'.

Referring now to FIG. 10, door 16' is operated using plural planar, rigid door pivot arms 60', preferably fabricated of injection molded plastic. In the preferred embodiment, two arms 60' are provided, one at each of sides 16*a'* and 16*b'* of door 16'. Arm 60' is generally similar to arm 60 in that it comprises a circular disk portion 62' integrally formed with a tangential arm portion 64' shown in FIG. 3. However, the configuration of disk portion 62' and arm portion 64' differ somewhat from the configuration of disk portion 62 and arm portion 64, as will now be described.

Disk portion 62' has a circularly arcuate smooth portion 62*a'* and a circularly arcuate rack portion 62*b'* having circumferential teeth 62*c'*, for a purpose to be described hereinafter. The radius R1' of smooth portion 62*a'* is smaller than the radius R2' of rack portion 62*b'*. However, smooth portion 62*a'* and rack portion 62*b'* are concentric, i.e. they have the same center, and this center is considered to be the center of disk portion 62'. Smooth portion 62*a'* transitions to rack portion 62*b'* at a common radius R3'.

Arm portion 64' has a first side 64*a'* formed as a tangent of smooth portion 62*a'*; a second side 64*b'* formed as an asymmetric U-shape extending outwardly and downwardly from rack portion 62*b'* and spaced apart from first side 64*a'*; an outer end 64*c'* which joins first and second sides 64*a'* and 64*b'*; an inner end 64*d'* which is coextensive with a portion of the circumference of smooth portion 62*a'* and a portion of the circumference of rack portion 62*b'*; and a bracket 64*e'* (FIG. 14) extending perpendicularly from outer end 64*c'* and formed unitarily with outer end 64*c'*. Door 16' is mounted to brackets 62*e'* of arms 64', as shown in FIG. 14.

First side 64*a'* forms an angle of approximately 57° with outer end 64*c'*. Thus, when door 16' is closed as shown in FIG. 10, side 64*a'* is arranged at an angle of approximately 33° relative to horizontal. Radius R3', at which the transition occurs between smooth portion 62*a'* and rack portion 62*b'*, forms an angle of approximately 45° with first side 64*a'* of arm portion 64'.

Like disk portion 62, disk portion 62' is provided with three cutout portions, namely a first circularly arcuate slot 66', a second circularly arcuate slot 68', and an ellipsoidal slot 70'. One of the circles defining the ellipsoidal shape of slot 70' is preferably substantially concentric with disk smooth portion 62*a'* and rack portion 62*b'*, and thus with disk portion 62', the center of the circle being offset very slightly from the center of disk portion 62'. The major axis of the ellipsoid is collinear with common radius R3' of smooth portion 62*a'* and rack portion 62*b'*.

Like slots 66 and 68, slots 66' and 68' are concentric with disk portion 62', the radius of slot 66' being greater than the radius of slot 68', and slot 66' being longer than slot 68'. Slots 66' and 68' also are arranged opposite each other and are non-parallel. As shown in FIG. 10, slot 66' is provided with a semicircular first end 66*a'* and a second locking end 66*b'* located adjacent inner end 64*d'* of arm portion 64'. This locking end 66*b'* is formed by a semi-ellipsoidal notch 66*c'* having a major axis collinear with the major axis of slot 70' and extending radially outwardly from slot 66'. Channel 68' similarly includes a semicircular first end 68*a'* and a second locking end 68*b'* formed by a semi-elliptical notch 68*c'* having a major axis collinear with the major axis of slot 70', but extending radially inwardly from slot 68'. The diameters of the semicircles forming first ends 66*a'* and 68*a'* are collinear with the center of disk portion 62', the line which they define forming an angle of approximately 90° with the major axes of slot 70' and notches 66c' and 68c'.

A cover panel 80' is provided as shown in FIGS. 10 and 13 for placement over each arm 60'. Although only one cover panel 80' is shown, it should be understood that the cover panels 80' at either side of cabinet 100' are mirror images of each other. Each of cover panels 80' is generally rectangular in shape, having a side wall 80a', and projecting outwardly from side wall 80a' a top wall 80b', a rear wall 80c', a bottom wall 80d', and a front wall 80e'. Although each cover panel 80' is generally rectangular, front wall 80e' is connected to top wall 80b' by an arcuate corner portion 80f' generally parallel to the arcuate profile of door 16'. Front wall 80e', including arcuate corner portion 80f' has a notch 80g' formed at the edge thereof along substantially its entire length, to provide clearance for arm 60' as it moves between the open and closed position. Also, top wall 80b' has a rectangular notch 80h' centrally formed at the edge thereof, and an inset portion 80i' adjacent notch 80h', for a purpose to be described hereinafter.

Side wall 80a' is provided with three spaced bosses or weldnuts 80j' for receiving screws (not shown) for securing cover panels 80' to end walls 12'. A reinforcing rib 80k' is also formed in side wall 80a', and extends between rear wall 80c' and bottom wall 80d' of cover panel 80', intersecting the lower two bosses 80j'. Also, an inwardly-extending V-shaped shoulder 801' is formed at the corner between bottom wall 80d' and front wall 80e', for a purpose to be described hereinafter.

Three inwardly-projecting cylindrical bolts or studs 72a', 72b', and 72c' are affixed to the interior surface of cover panel 80' as shown in FIG. 10 to cooperate with slots 66', 70', and 68' respectively, in the same manner as studs 72a, 72b, and 72c cooperate respectively with slots 66, 70, and 68. Studs 72a', 72b', and 72c' are collinear, and form and angle of approximately 12° with the horizontal.

Referring now to FIGS. 10–12, in order to provide improved operation of door 16', pinions 84' having teeth 84a' are provided adjacent end walls 12' to engage the rack portion 62b' of each of arms 60'. A mounting bushing 86' is mounted at the rear of guide channel 26', for example by a screw 88', in registration with inset portion 80i' of cover panel 80', and offset from each of end walls 12'. Each of mounting bushings 86' has an aperture 86a' therethrough for receiving an equalizer rod or shaft 90', on which pinions 84' are journaled. As shown in FIGS. 10 and 11, pinion 84' extends downwardly through notch 80h' of cover panel 80'.

As a result of the cooperation between rack portions 62b' of arms 60', pinions 84', and rod 90', door 16' can be opened and closed by a force exerted not only at the center, but also at either side.

Bumpers 92' are provided on shoulders 801' for engaging sides 64b' of arms 60' in the closed position.

Like cabinet 100, cabinet 100' can be used as one part of an integrated modular furniture system which includes one or more modular vertical wall panels 200 as shown in FIG. 14. Cabinet 100' is mounted to standards 206 in panel 200 using mounting brackets 300'.

Although only one of brackets 300' is shown, it should be understood that they ar mirror-images of each other. Brackets 300' are preferably constructed with a generally rectangular bracket body 302' having opposed top and bottom edges 302a' and 302b', opposed vertical outer and inner side edges 302c' and 302d', a rearwardly-facing vertical ledge 306' extending perpendicularly along the length of vertical outer side edge 302c', a forward-facing L-shaped horizontal flanges 308a' extending perpendicularly along the length of horizontal top edge 302a', and a forward facing horizontal flange 308b' extending perpendicularly along the length of bottom edge 302b'. L-shaped flange 308a' engages channel 28' in rear wall 18', while flange 308b' engages the lower surface of flange 18g' of rear wall 18'. Flanges 308a' and 308b' are secured to channel 28' and bottom wall 14' by conventional means, for example by screws (not shown).

Vertical ledge 306' of bracket 300' is provided with plural rearward-facing bracket teeth 312' which engage slots 208 of standard 206. As shown in FIG. 14, there are one lower, downward facing tooth 312' and three upper teeth 312', the top one of which is bi-directional and the bottom two of which are downward facing. When cabinet 100' is mounted on modular wall 200, teeth 312' lock into slots 208.

Figure 16:
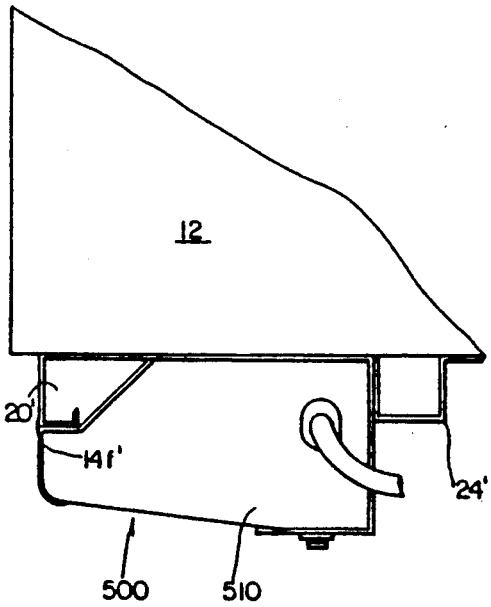
FIG. 16 is a partial side elevational view taken along line 16—16 of FIG. 15.
Figure 17:
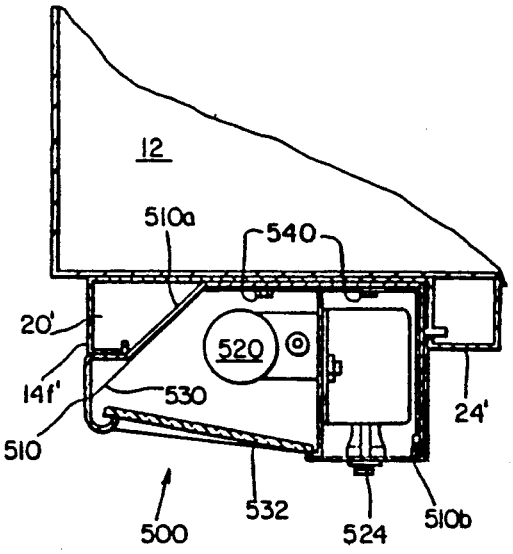
FIG. 17 is a partial cross-sectional view taken along line 17—17 of FIG. 15.

As shown in FIGS. 16 and 17, a light fixture 500 can be provided in cavity 20' under bottom wall 14'. Light fixture 500 comprises a housing 510 having a forward compartment 510a and a rearward compartment 510b. A lamp 520, preferably fluorescent, is mounted in forward compartment 510a, while a ballast 522 is mounted in rearward compartment 510b. An on/off switch 524 connected to ballast 522 extends through rearward compartment 510b for access to the user seated below. Forward compartment 510b can be provided with a reflector 530 covering its top, front, and rear walls. The bottom wall of forward compartment 510b is open, being covered by a lens or diffusing panel 532. Housing 510 is secured to cabinet 100' by screws 540 through bottom wall 14' and the front edge of support channel 24'.

Figure 18:
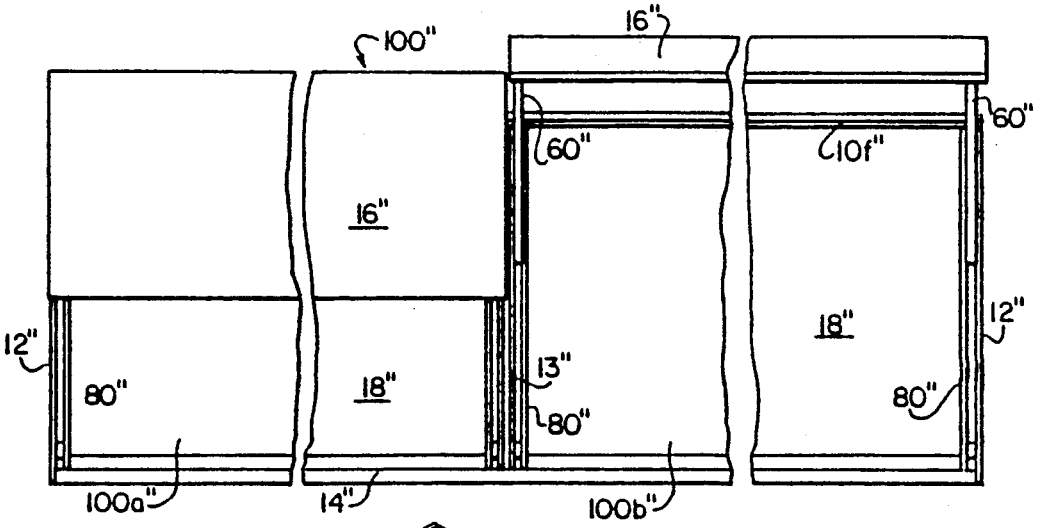
FIG. 18 is a front elevational view of a cabinet according to a third embodiment of the invention.
Figure 20:
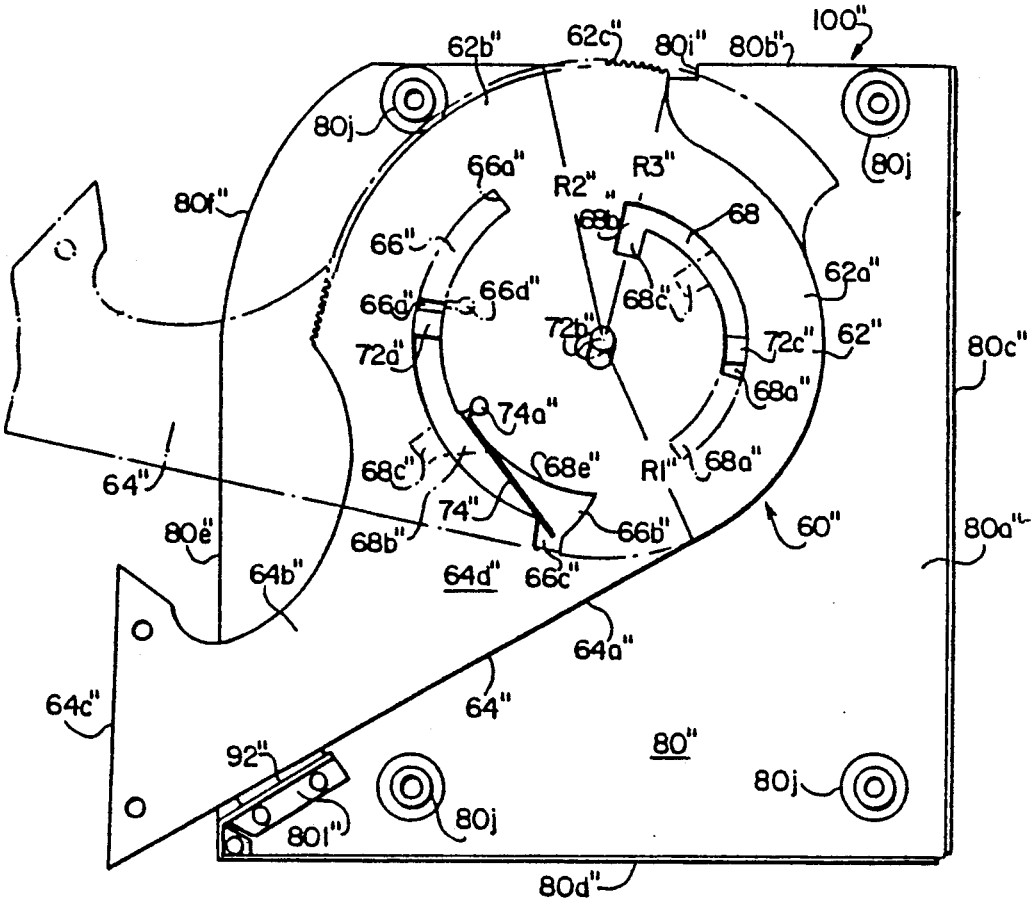
FIG. 20 is a cross-sectional view taken along line 20—20 of FIG. 19, showing the mounting arm in the closed position, the partially open position of the mounting arm being shown in dashed lines.
Figure 21:
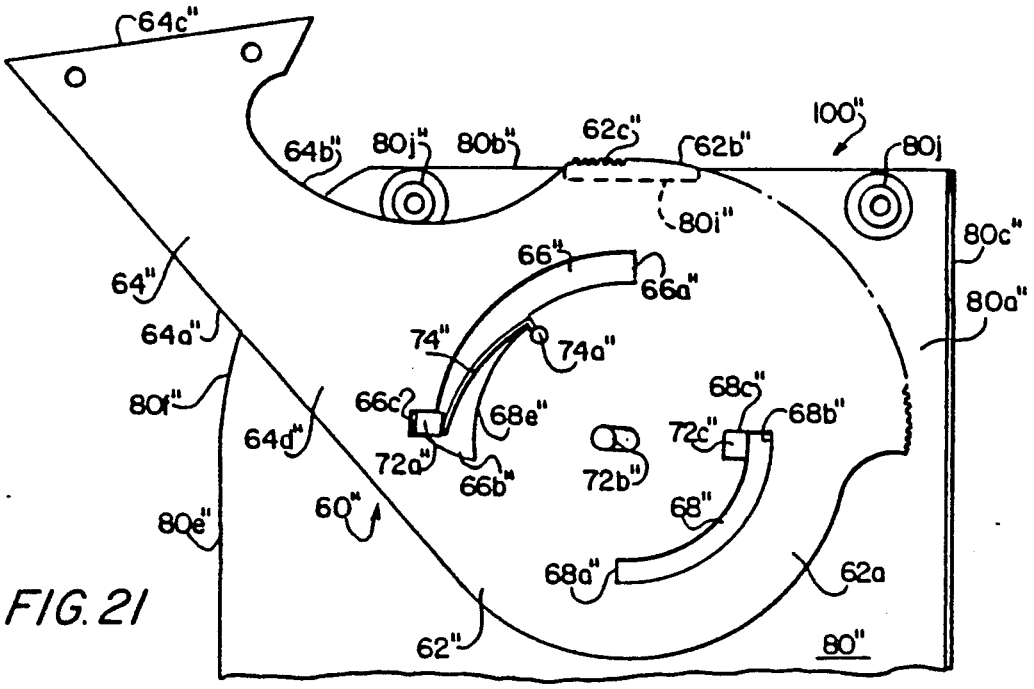
FIG. 21 is a cross-sectional view similar to FIG. 20, but with the mounting arm in the fully open position.
Figure 22:
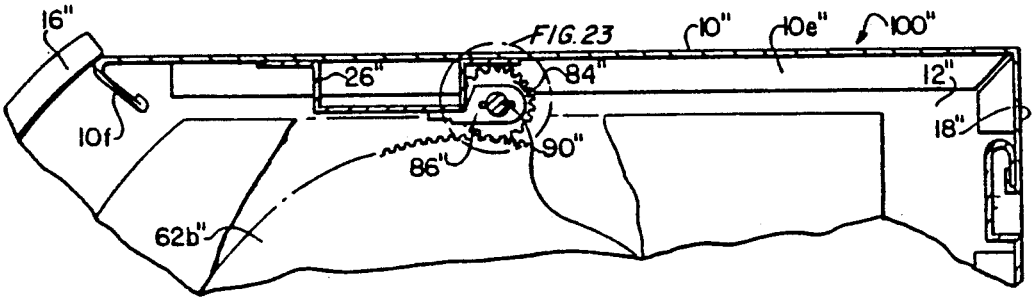
FIG. 22 is a partial cross-sectional view of the cabinet of FIG. 18 as assembled.

Referring now to FIGS. 18–28, there is shown a cabinet 100" in accordance with a third embodiment of the invention. Cabinet 100" is generally similar to cabinet 100' shown in FIGS. 10–17, with differences as will be described hereinafter. As shown in FIGS. 18 through 21, cabinet 100" includes a generally rectangular top wall 10" (FIG. 22); two symmetrically identical, opposed end walls 12" (FIGS. 18 and 22); a center wall 13" (FIGS. 18 and 19) intermediate end walls 12", dividing the interior of cabinet 100" into two portions 100a" and 100b" (FIG. 18); a generally rectangular bottom wall 14" (FIG. 18); and a rectangular rear wall 18" (FIGS. 18 and 22). A pair of side-by-side, curved, upwardly-movable cabinet doors 16" (FIGS. 18 and 22) selectively provide access to the interior of cabinet portions 100a" and 100b".

Figure 23:
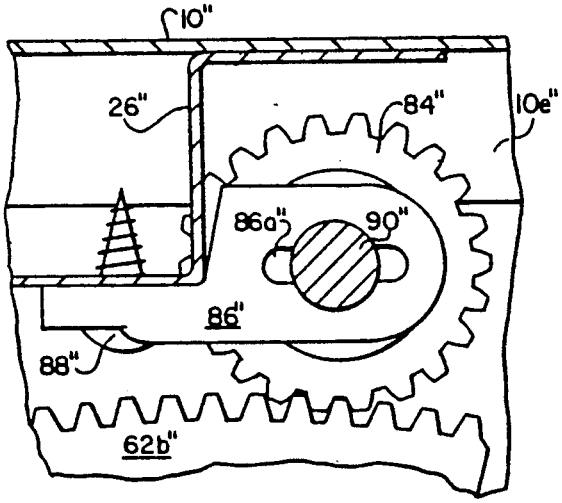
FIG. 23 is an enlarged cross-sectional view showing the structure indicated by the dashed line in FIG. 22.

As indicated in FIGS. 22 and 23, a shelf bracket guide channel 26" similar to guide channel 26' in cabinet 100' is secured to the lower surface of top wall 10". A fascia strip 10f" similar to fascia strip 10f and 10f' is formed integrally with front edge 10c" of top wall 10", as best seen in FIGS. 18 and 22, to conceal guide channel 26".

Cabinet 100" can be provided with vertical shelf brackets 30 and horizontal shelves 40 in a manner similar to cabinets 100 and 100'.

As indicated in FIG. 18, each door 16" is operated using plural planar, rigid door pivot arms 60", preferably fabricated of injection molded plastic. In the preferred embodiment, four arms 60" are provided, one at each of sides 16a" and 16b" of each door 16".

Figure 19:
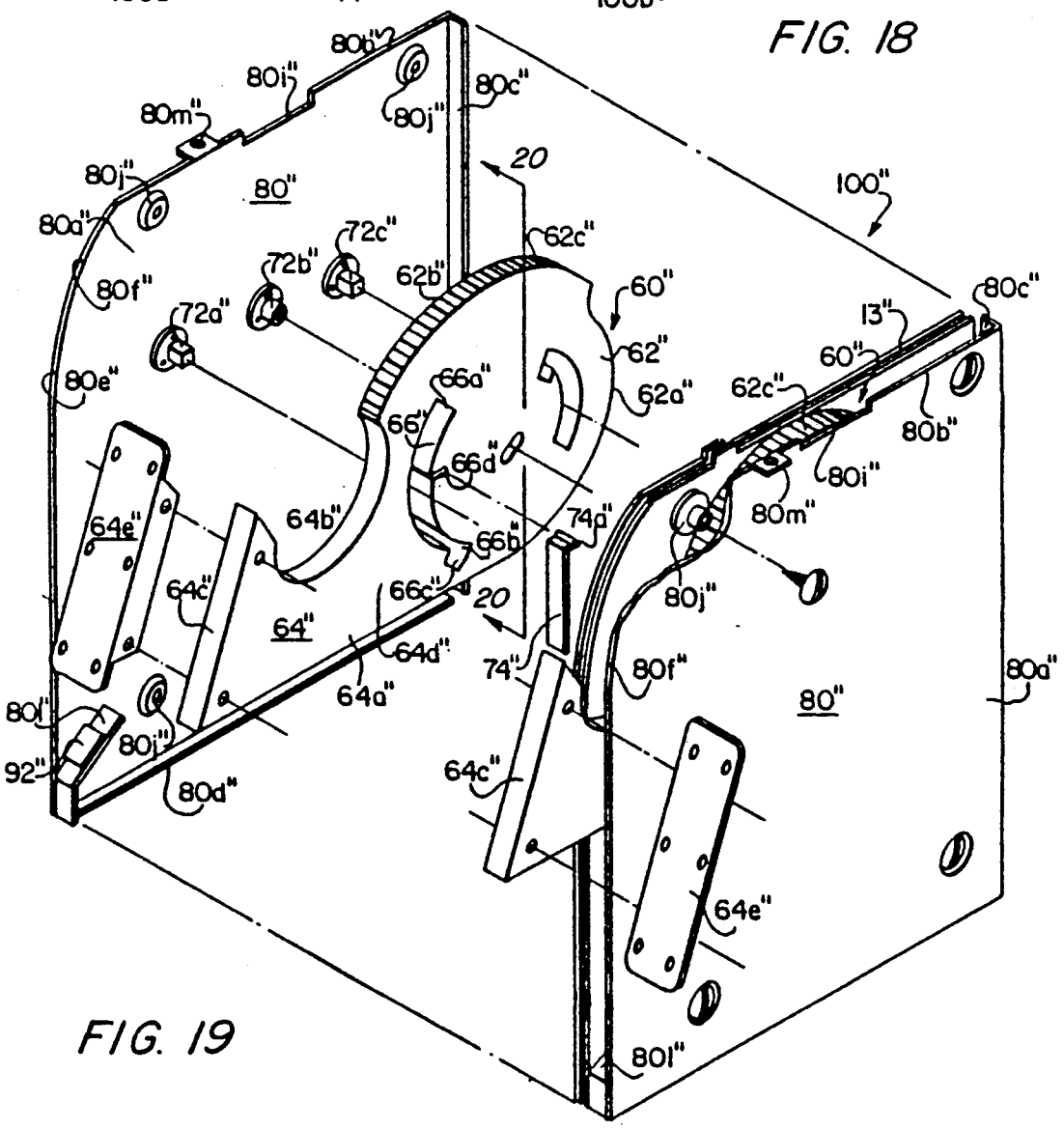
FIG. 19 is an exploded perspective view with parts broken away of the cabinet of FIG. 18.

Referring now to FIGS. 19–21, arm 60″ is generally similar to arm 60′ in that it comprises a circular disk portion 62″ integrally formed with a tangential arm portion 64″, and in that disk portion 62″ has a circularly arcuate smooth portion 62*a*″ and a circularly arcuate rack portion 62*b*″ having circumferential teeth 62*c*″. The radius R1″ of smooth portion 62*a*″ is smaller than the radius R2″ of rack portion 62*b*″, and smooth portion 62*a*″ and rack portion 62*b*″ are concentric. Smooth portion 62*a*″ transitions to rack portion 62*b*″ at a common radius R3″.

Arm portion 64″ has a first side 64*a*″ formed as a tangent of smooth portion 62*a*″; an inwardly curved second side 64*b*″ spaced apart from first side 64*a*″; an outer end 64*c*″ which joins first and second sides 64*a*″ and 64*b*″; and an inner end 64*d*″ which is coextensive with a portion of the circumference of smooth portion 62*a*″ and a portion of the circumference of rack portion 62*b*″. A separate bracket portion 64*e*″ (FIG. 19) is attached to outer end 64*c*″, for example by screws (not shown) for mounting doors 16″ to arms 60″.

Side 64*a*″ forms an angle of approximately 57° with outer end 64*c*″. Radius R3″, at which the transition occurs between smooth portion 62*a*″ and rack portion 62*b*″, forms an angle of approximately 45° with first side 64*a*″.

Like disk portions 62 and 62′, disk portion 62″ is provided with three cutout portions, namely a first arcuate slot 66″, a second arcuate slot 68″, and an ellipsoidal slot 70″. One of the circles defining the ellipsoidal shape of slot 70″ is preferably substantially concentric with disk smooth portion 62*a*″ and rack portion 62*b*″. The major axis of the ellipsoid is collinear with common radius R3″ of smooth portion 62*a*″ and rack portion 62*b*″.

Like slots 66, 66′, 68, and 68′, slots 66″ and 68″ are circularly arcuate and concentric with disk portion 62″, the radius of slot 66″ being greater than the radius of slot 68″, and slot 66″ being longer than slot 68″. Slots 66″ and 68″ also are arranged opposite each other and are nonparallel. Slot 66″ is provided with a squared-off first end 66*a*″ and a second locking end 66*b*″ located adjacent inner end 64*d*″ of arm portion 64″. This locking end 66*b*″ is formed by a squared off notch 66*c*″ extending radially outwardly from slot 66″ and having a radial axis collinear with the major axis of slot 70″. Channel 68″ similarly includes a squared-off first end 68*a*″ and a second locking end 68*b*″ formed by a squared-off notch 68*c*″ extending radially inwardly from slot 68″ and having a radial axis collinear with the major axis of slot 70″. First ends 66*a*″ and 68*a*″ are substantially collinear with the center of disk 62″, the line which they define forming an angle of approximately 90° with the major axis of slot 70″ and the radial axes of notches 66*c*″ and 68*c*″.

Slot 68″ also differs from slots 68 and 68′ in having a keyhole 68*d*″ of circular cross-section extending radially inwardly from its inner diameter at a point approximately midway between first end 68*a*″ and locking end 68*b*″. Further, the inner diameter of slot 68″ between keyhole 68*d*″ and locking end 68*b*″ is reduced at a portion designated 68*e*″, i.e. it is slightly smaller than its inner diameter between keyhole 68*c*″ and first end 68*a*″.

Reduced diameter portion 68*e*″ accommodates an L-shaped flat spring clip 74″, for a purpose to be described hereinafter. Spring clip 74″ is provided with a cylindrical extension 74*a*″ at the end of its shorter leg for locking engagement with keyhole 68*d*″.

Figure 26:
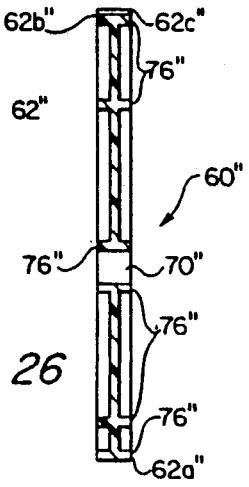
FIG. 26 is a cross-sectional view taken along line 26—26 of FIG. 25.
Figure 28:
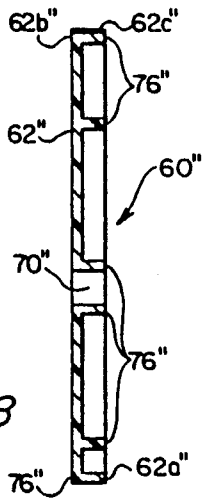
FIG. 28 is a cross-sectional view taken along line 28—28 of FIG. 27.
Figure 25:
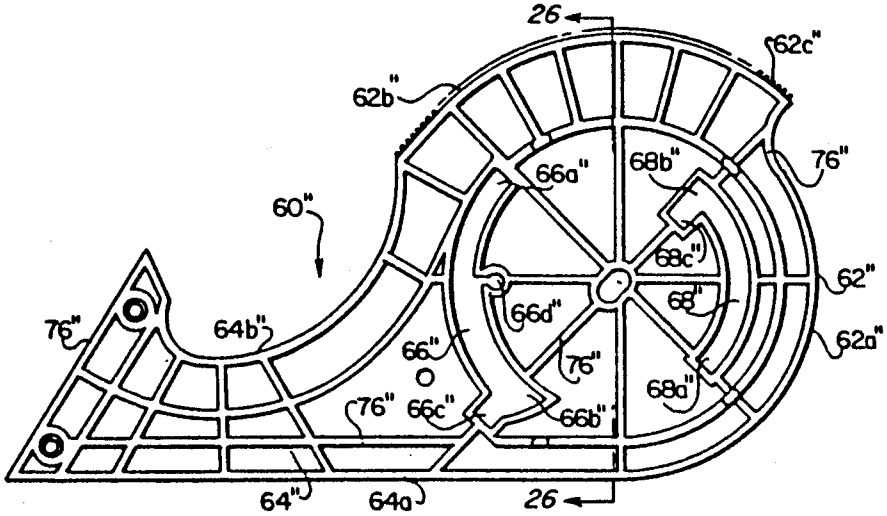
FIG. 25 is a side elevational view of a first embodiment of a mounting arm for use in the cabinet of FIG. 18.
Figure 27:
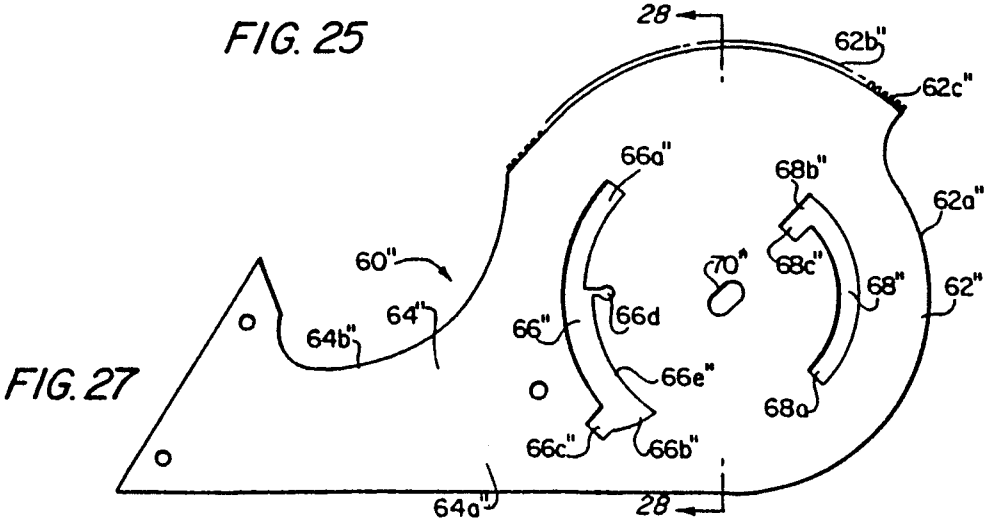
FIG. 27 is a side elevational view of a second embodiment of a mounting arm for use in the cabinet of FIG. 18.

As shown in FIGS. 25 and 26, arm 60″ can be formed for "universal" use on either the left or right side of cabinet 100″ or the left or right side of center wall 13″, with radial and peripheral reinforcing ribs 76″ on both sides. Alternatively, as shown in FIGS. 27 and 28, arm 60″ can be formed for "left" or "right" side use only, with the reinforcing ribs 76″ formed on one side and the exposed side being smooth. Arms 60 and 60′ can similarly be formed for "universal" use, or for "left" or "right" use only.

A cover panel 80″ is provided as best shown in FIGS. 19 through 21, for placement over each arm 60″. Cover panels 80″ have a side wall 80*a*″, a top edge 80*b*″, a front edge 80*e*″, and projecting inwardly from side wall 80*a*″, a rear wall 80*c*″ and a bottom wall 80*d*″. An arcuate corner portion 80*f*″ connects front edge 80*e*″ to top edge 80*b*″. Top and front walls are omitted along top and front edges 80*b*″ and 80*e*″, to provide clearance for arm 60″ as it moves between the open and closed position. Also, top edge 80*b*″ has a rectangular inset notch 80*i*″ centrally formed at the edge thereof, for a purpose to be described hereinafter. Side wall 80*a*″ is provided with four spaced bosses or weldnuts 80*j*″, one at each corner, for receiving screws for securing cover panels 80″ to end walls 12″ and intermediate wall 13″. A shoulder 801″ is formed at the corner between bottom wall 80*d*″ and front wall 80*e*″, at an acute angle to bottom wall 80*d*″, for a purpose to be described hereinafter. A horizontally-extending tab 80*m*″ is provided forwardly of notch 80*i*″ for securing cover panel 80″ to the lower surface of top wall 10″.

Three inwardly-projecting bolts or studs 72*a*″, 72*b*″, and 72*c*″ are affixed to the interior surface of cover panel 80″ as shown in FIG. 19 to cooperate with slots 66″, 70″, and 68″ respectively, in the same manner as studs 72*a*′, 72*b*′, and 72*c*′ cooperate respectively with slots 66′, 70′, and 68′. However, studs 72*a*″ and 72*c*″ are square in cross-section, while stud 70″ is circular in cross-section. Studs 72*a*″, 72*b*″, and 72*c*″ are collinear, and form and angle of approximately 31° with the horizontal. Spring clip 74″ bears against stud 72*c*″ to bias it into engagement with locking end 68*b*″ of slot 68″.

Figure 24:
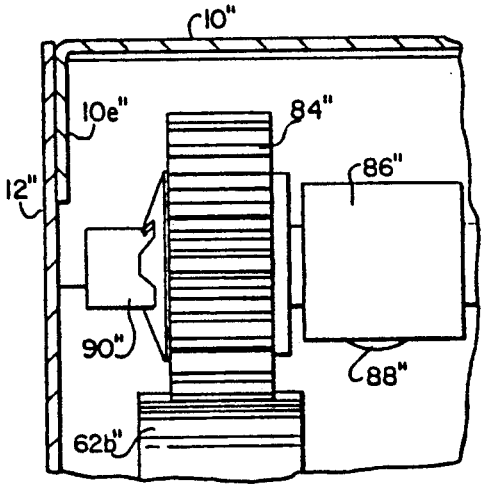
FIG. 24 is a rear cross-sectional view of the structure of FIG. 23.

Referring now to FIGS. 22–24, as in cabinet 100′, pinions 84″ having teeth 84*a*″ are provided adjacent end walls 12″, and also on either side of and adjacent center wall 13″, to engage the rack portion 62*b*″ of each of arms 60″. A mounting bushing 86″ is mounted at the rear of guide channel 26″, for example by a screw 88″, in registration with inset notch 80*i*″ of cover panel 80″ and offset from each of end walls 12″ and one side of center wall 13″. Each of mounting bushings 86″ has an aperture 86*a*″ therethrough for receiving an equalizer rod or shaft 90″, on which pinions 84″ are journaled.

Bumpers 92″ are provided on shoulders 801″ for engaging sides 64*b*″ of arms 60″ in the closed position.

Cabinet 100″ can be mounted to standards 206 in a panel 200 using mounting brackets similar to mounting brackets 300′ shown in FIG. 14. Also, cabinet 100″ can be provided with shelf brackets 30 and shelves 40, and with a light fixture 500, as described above.

Cabinets 100, 100′, and 100″ possess a number of advantages over prior art articles of furniture having upwardly-movable or rotatable doors. For example, the attachment of pivot arms 60, 60′, and 60″ to the bottoms of doors 16, 16′, and 16″ allows doors 16, 16′, and 16″ to swing clear of cabinets 100, 100′, and 100″ in the open position, instead of taking up space inside of cabinets 100, 100′, and 100″. Also, because pivot arms 60, 60′, and 60'' are mounted at the sides of cabinets 100, 100', and 100'' instead of beneath their top walls, they create clear space inside of cabinets 100, 100', and 100'' and do not interfere with the attachment of vertical shelf brackets 30 to guide channels 26, 26', and 26''.

Channels 28 and 28' extend the full width of the cabinets, allowing brackets 300 and 300' to be located inwardly, and therefore invisibly, from the sides of the cabinets. They also permit the cabinets to be set only brackets 300 and 300' after brackets 300 or 300' are attached to their respective stanchions. Further, brackets 300 and 300' can be attached to any conventional stanchions with longitudinal slots, thus allowing cabinets 100, 100', and 100'' to be mounted to a wall or any other surface to which stanchions can be fastened.

The invention having a preferred embodiment described above may be practiced in many ways other than as specifically described. For example, the rotatable arms can be used to rotatably mount a door in an article of furniture other than the cabinets described herein, or to rotatably mount articles other than a door. Therefore, within the scope of the appended claims, the invention should be considered to include all technically equivalent structures functioning in a substantially similar manner to achieve substantially similar results.

What is claimed is:

1. An article of furniture comprising:

first and second opposed, parallel walls;

a door;

first and second mounting means rotatably mounted adjacent said first and second walls, respectively, for moving said door between an open position and a closed position, each of said first and second mounting means comprising:

a disk portion at least a portion of which has a substantially circular circumference and a center and a tangential arm portion extending outwardly from said disk portion;

said arm portion having a first side tangent to said circumference of said disk portion, a second side spaced apart from said first side, an outer end connecting said first and second sides, and an inner end at least partially coextensive with said circumference of said disk portion; and said disk portion having an elongate central slot axially aligned along a diameter of said disk portion, a first circularly arcuate slot inset from said circumference of said disk portion and having a first radius, and a second circularly arcuate slot having a second radius which is smaller than said first radius, said first and second arcuate slots each having first and second ends, and said first and second arcuate slots being concentric with said disk portion;

pivot means providing a pivot point for rotation of said elongate central slot about a horizontal axis extending therethrough; and first and second guide means received respectively in said first and second arcuate slots for guiding said disk portion as said elongate central slot rotates about said pivot means.

2. The article of furniture of claim 1, wherein said elongate slot has a substantially ellipsoidal shape defined by a pair of spaced circles, and wherein one of said circles is substantially concentric with said disk portion.

3. The article of furniture of claim 1, wherein said first and second arcuate slots are opposite each other and are nonparallel.

4. The article of furniture of claim 3, wherein said first ends of said arcuate slots are substantially collinear with said center of said disk portion to define a first line and said second ends of said arcuate slots are substantially collinear with said center of said disk portion to define a second line.

5. The article of furniture of claim 4, wherein said first and second lines form an angle of approximately 90°.

6. The article of furniture of claim 5, wherein said second end of said first arcuate slot includes a first notch extending radially outwardly therefrom and wherein said second end of said second arcuate slot includes a second notch extending radially inwardly therefrom, said first and second guide means respectively engaging said first and second notches when said door is in said open position for locking said door in said open position, and each of said notches having a longitudinal axis which is substantially coextensive with said second line.

7. The article of furniture of claim 4, wherein said disk portion includes a rack portion having a radius greater than the remaining portion of said disk portion, said rack portion including circumferential teeth; and wherein said article of furniture further comprises first and second pinions pivotably mounted to said first and second sides, respectively, and engaging said rack portion of said first and second mounting means.

8. The article of furniture of claim 7, wherein said disk portion extends approximately from said second side of said arm portion to said second line.

9. The article of furniture of claim 1, wherein said second end of said first arcuate slot includes a first notch extending radially outwardly therefrom and wherein said second end of said second arcuate slot includes a second notch extending radially inwardly therefrom, said first and second guide means respectively engaging said first and second notches when said door is in said open position for locking said door in said open position.

10. The article of furniture of claim 6, wherein each of said mounting means further includes biasing means for biasing said first notch into locking engagement with said first guide means.

11. The article of furniture of claim 10, wherein said biasing means comprises a spring inserted in said first arcuate slot.

12. The article of furniture of claim 1, wherein said pivot means and said first and second guide means are substantially collinear.

13. The article of furniture of claim 1, wherein said disk portion includes a rack portion having a radius greater than the remaining portion of said disk portion, said rack portion including circumferential teeth; and wherein said article of furniture further comprises first and second pinions pivotably mounted adjacent said first and second sides, respectively, and engaging said rack portion of said first and second mounting means.

14. The article of furniture of claim 1, wherein said article of furniture further comprises first and second cover panels covering said disk portion of said first and second mounting means, respectively, said first mounting means being interposed between said first cover panel and said first wall and said second cover panel being interposed between said second cover panel and said second wall.

15. The article of furniture of claim 14, wherein said pivot means and said guide means are part of said first and second cover panels.

16. The article of furniture of claim 1, further comprising:

a plurality of spaced-apart shelf brackets parallel to and intermediate said first and second walls, each of said shelf brackets having spaced openings therein; and a plurality of shelves positioned between and perpendicular to said shelf brackets, said shelves having tabs extending therefrom for engaging said openings in said shelf brackets.

17. A rotatable mounting mechanism for a door comprising:

a substantially circular disk portion having a circumference and a tangential arm portion extending outwardly from said disk portion;

said arm portion having a first side tangent to said circumference of said disk portion, a second side spaced apart from said first side, an outer end connecting said first and second sides, and an inner end at least partially coextensive with said circumference of said disk portion; and said disk portion having an elongate central slot axially aligned along a diameter of said disk portion, a first circularly arcuate slot inset from said circumference of said disk portion and having a first radius, and a second circularly arcuate slot having a second radius which is smaller than said first radius, said first and second arcuate slots each having first and second ends.

18. The mechanism of claim 17, wherein said elongate slot has a substantially ellipsoidal shape defined by a pair of spaced circles, and wherein one of said circles is substantially concentric with said disk portion.

19. The mechanism of claim 17, wherein said first and second arcuate slots are opposite each other and are nonparallel.

20. The mechanism of claim 19, wherein said first ends of said arcuate slots are substantially collinear with said center of said disk portion to define a first line and said second ends of said arcuate slots are substantially collinear with said center of said disk portion to define a second line.

21. The mechanism of claim 20, wherein said first and second lines form an angle of approximately 90°.

22. The mechanism of claim 17, wherein said second end of said first arcuate slot includes a first notch extending radially outwardly therefrom and wherein said second end of said second arcuate slot includes a second notch extending radially inwardly therefrom.

23. The mechanism of claim 21, wherein said second end of said first arcuate slot includes a first notch extending radially outwardly therefrom and wherein said second end of said second arcuate slot includes a second notch extending radially inwardly therefrom, each of said notches having a longitudinal axis which is substantially coextensive with said second line.

24. A rotatable mounting mechanism for a door comprising:

a disk portion having a circularly arcuate smooth portion and a circularly arcuate rack portion with circumferential teeth, said smooth portion having a circumference and a first radius, and said rack portion having a second radius smaller than said first radius;

a tangential arm portion extending outwardly from said disk portion between said smooth and said rack portions;

said arm portion having a first side tangent to said circumference of said smooth portion, a second side spaced apart from said first side, an outer end connecting said first and second sides, and an inner end at least partially coextensive with said circumference of said disk portion; and said disk portion having an elongate central slot axially aligned along a diameter of said smooth portion, a first circularly arcuate slot inset from said circumference of said smooth portion and having a first radius, and a second circularly arcuate slot having a second radius which is smaller than said first radius, said first and second arcuate slots each having first and second ends.

25. The mechanism of claim 24, wherein said elongate slot has a substantially ellipsoidal shape defined by a pair of spaced circles, and wherein one of said circles is substantially concentric with said disk portion.

26. The mechanism of claim 24, wherein said first and second arcuate slots are opposite each other and are nonparallel.

27. The mechanism of claim 26, wherein said first ends of said arcuate slots are substantially collinear with said center of said disk portion to define a first line and said second ends of said arcuate slots are substantially collinear with said center of said disk portion to define a second line.

28. The mechanism of claim 27, wherein said first and second lines form an angle of approximately 90°.

29. The mechanism of claim 28, wherein said second end of said first arcuate slot includes a first notch extending radially outwardly therefrom and wherein said second end of said second arcuate slot includes a second notch extending radially inwardly therefrom, each of said notches having a longitudinal axis which is substantially coextensive with said second line.

30. The mechanism of claim 24, wherein said second end of said first arcuate slot includes a first notch extending radially outwardly therefrom and wherein said second end of said second arcuate slot includes a second notch extending radially inwardly therefrom.

* * * * *